US006965359B2

(12) United States Patent
Ishii et al.

(10) Patent No.: US 6,965,359 B2
(45) Date of Patent: Nov. 15, 2005

(54) METHOD OF DRIVING PLASMA DISPLAY PANEL BY APPLYING DISCHARGE SUSTAINING PULSES

(75) Inventors: Tomoyuki Ishii, Kawasaki (JP); Tadatsugu Hirose, Kawasaki (JP); Yoshikazu Kanazawa, Kawasaki (JP); Toshio Ueda, Kawasaki (JP); Tomokatsu Kishi, Kawasaki (JP); Shigetoshi Tomio, Kawasaki (JP); Fumitaka Asami, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 243 days.

(21) Appl. No.: 09/966,510

(22) Filed: Sep. 28, 2001

(65) Prior Publication Data

US 2002/0021265 A1 Feb. 21, 2002

Related U.S. Application Data

(62) Division of application No. 08/690,038, filed on Jul. 31, 1996, now Pat. No. 6,373,452.

(30) Foreign Application Priority Data

Aug. 3, 1995 (JP) ..... 7-198417
Oct. 4, 1995 (JP) ..... 7-284541

(51) Int. Cl.[7] ..... G09G 3/28

(52) U.S. Cl. ..... 345/63; 345/66; 345/67; 315/169.4

(58) Field of Search ..... 345/60–72, 690; 315/169.1–169.4; 313/585

(56) References Cited

U.S. PATENT DOCUMENTS

| | | | |
|---|---|---|---|
| 4,296,357 A | 10/1981 | Hirayama et al. | |
| 4,728,864 A | 3/1988 | Dick | |
| 4,737,687 A | 4/1988 | Shinoda et al. | |
| 5,081,400 A | 1/1992 | Weber et al. | |
| 5,107,182 A | 4/1992 | Sano et al. | |
| 5,212,472 A | 5/1993 | Takahashi et al. | |
| 5,317,334 A | 5/1994 | Sano | |
| 5,436,634 A | 7/1995 | Kanazawa | |
| 5,446,344 A | 8/1995 | Kanazawa | |
| 5,453,660 A | 9/1995 | Martin et al. | |
| 5,656,893 A | 8/1997 | Shino et al. | |
| 5,659,226 A | 8/1997 | Shigeta | |
| 5,696,523 A | 12/1997 | Yano | |
| 5,701,056 A | 12/1997 | Shinohara | |
| 5,744,909 A | 4/1998 | Amano | |
| 5,907,311 A | 5/1999 | Yano | |
| 6,373,452 B1 * | 4/2002 | Ishii et al. | 345/67 |

FOREIGN PATENT DOCUMENTS

| | | |
|---|---|---|
| FR | 2 694 118 | 1/1994 |
| JP | 61176035 | 8/1986 |
| JP | 63131436 | 6/1988 |
| JP | 63232238 | 9/1988 |
| JP | 02148645 | 6/1990 |
| JP | 2-220330 | 9/1990 |
| JP | 04312742 | 11/1992 |
| JP | 05002993 | 1/1993 |
| JP | 6-175607 | 6/1994 |
| JP | 07029497 | 1/1995 |

OTHER PUBLICATIONS

1996 National Convention Record I.E.E., Japan; Mar. 10, 1996.

* cited by examiner

*Primary Examiner*—Amr A. Awad
(74) *Attorney, Agent, or Firm*—Greer, Burns & Crain, Ltd.

(57) ABSTRACT

Method for driving a plasma display panel. At least one first discharge sustaining pulse is applied to a first pair of display electrodes, and at least one second discharge sustaining pulse applied to an adjacent pair of display electrodes. The first and second discharge sustaining pulses are applied such that they are in the same phase as one another and/or such that a current in the first pair of display electrodes flows in the opposite direction from a current in the adjacent pair of display electrodes.

5 Claims, 31 Drawing Sheets

W: WHOLE SCREEN WRITE DISCHARGE
E: WHOLE SCREEN SELF-ERASING DISCHARGE
A: ADDRESS DISCHARGE
S: SUSTAINING DISCHARGE

METHOD OF DRIVING PLASMA DISPLAY PANEL BY APPLYING DISCHARGE SUSTAINING PULSES

This Application is a divisional of application Ser. No. 08/690,038, filed Jul. 31, 1996, now U.S. Pat. No. 6,373,452, issued Apr. 16, 2002.

BACKGROUND OF THE INVENTION

1. Field of the Invention

The present invention relates to a surface discharge AC plasma display panel, a method of driving same and a plasma display apparatus employing same.

2. Description of the Related Art

The plasma display panel (PDP) has good visibility because it generates its own light, is thin and can be made with large-screen and high-speed display. For these reasons it is attracting interest as a replacement for the CRT display. A surface discharge AC PDP is especially suitable for full color display. Therefore, there are high expectations in the field of high-vision and the demand for a higher quality image is increasing. A higher quality image is achieved by generating higher definition, a higher number of gradations, better brightness, lower brightness for black areas, higher contrast and the like. High definition is achieved by narrowing the pixel pitch, a higher number of gradations is achieved by increasing the number of subfields within a frame, higher brightness is achieved by increasing the number of times sustaining discharge is performed and lower brightness for deeper blacks is achieved by reducing the quantity of light emission during the reset period.

FIG. 30 shows the schematic structure of an surface discharge AC plasma display panel (PDP) 10P in the prior art.

On observer-side one of the glass substrates that face each other, electrodes X1 to X5 are formed parallel to one another at equal pitch and electrodes Y1 to Y5 are formed parallel to one another to form parallel pairs with the corresponding electrodes X1 to X5. On the other glass substrate, address electrodes A1 to A6 are formed in the direction that runs at a right angle to the aforementioned electrodes, and phosphor covers on that. Between the glass substrates that face each other, partitioning walls 171 to 177 and partitioning walls 191 to 196 are arranged intersecting each other in a lattice, to ensure that no erroneous display is made through discharge of one pixel affecting adjacent pixels.

The surface discharge PDPs have an advantage in that the phosphor does not become degraded due to the impact of ions on it since discharge occurs between adjacent electrodes on the same surface. However, since a pair of electrodes is provided for each of the display lines L1 to L5, the degree to which the pixel pitch can be reduced is limited and this is a stumbling block for achieving high definition. In addition, the scale of the drive circuit must be large since there is a high number of electrodes.

To deal with this problem, a PDP 10Q as shown in FIG. 31 has been disclosed in Japanese Patent Publication No. 5-2993 and No. 2-220330.

In the PDP 10Q, partitioning walls 191 to 199 are provided on the central lines of the electrodes X1 to X5 and Y1 to Y4, which are surface discharge electrodes, and these electrodes, except for the electrodes X1 and X5 at the two sides, i.e., the electrodes X2 to X4 and the electrodes Y1 to Y4, are commonly used by display lines that are adjacent in the direction of the address electrodes. With this, the number of electrodes is almost halved and the pixel pitch can be reduced, achieving higher definition compared to the PDP shown in FIG. 30. In addition, the scale of the drive circuit can also be halved.

However, in the publications cited above, since write is performed in linear sequence for the display lines L1 to L8, the discharge would affect adjacent pixels in the direction of the address electrodes if the partitioning walls 191 to 199 are omitted, resulting in erroneous display. Thus, the partitioning walls 191 to 199 cannot be omitted and this presents an obstacle to achieving higher definition by reducing the pixel pitch. In addition, it is not easy to provide the partitioning walls 191 to 199 on the central lines of the electrodes and, as a result, the PDP 10Q will be expensive to produce. Furthermore, in the publications mentioned above, a specific waveform of the voltage to be applied to the electrodes is not disclosed and, as a result, the invention has not been put into practical use. In order to make it possible to remove the partitioning walls running in the direction of the surface discharge electrodes, the distance between the electrodes at the two sides of each of the partitioning walls 191 to 196 must be increased in the structure shown in FIG. 30, so as to reduce the effect of their electric fields between that electrodes. Consequently, the pixel pitch increases, preventing achievement of higher definition. For instance, the distance between the electrodes Y1 and X2 (non display line) is 300 $\mu$m when the distance between the electrodes Y1 and X2 (display line) is 50 $\mu$m.

In addition, during the reset period, light is emitted because of the whole-screen (all pixel) discharge and brightness in the black display areas is increased, reducing the quality of the display.

Moreover, since the color of the phosphor is white or bright gray, incident light from the outside is reflected on the phosphor at non display line when observing an image on the PDP in bright place, lowering the contrast of the image.

In addition, since only one line can be addressed at a time, the address time cannot be reduced, and it is not possible to achieve a higher number of gradations by increasing the number of subfields or to achieve higher brightness by increasing the number of times sustaining discharge is performed.

SUMMARY OF THE INVENTION

Accordingly, a comprehensive object of the present invention is to provide a plasma display panel, a method of driving same and a plasma display apparatus, which achieve a higher quality image.

To put it concretely, a first object of the present invention is to provide a method of driving a plasma display panel and a plasma display apparatus, which achieve higher definition by further reducing a pixel pitch.

A second object of the present invention is to provide a plasma display panel, a method of driving the same and a plasma display apparatus that can increase black display quality reduced by whole-screen (all pixel) discharge light emission during a reset period.

A third object of the present invention is to provide a plasma display panel, a method of driving the same and a plasma display apparatus that can increase image contrast by decreasing the reflected light from a non display line.

A fourth object of the present invention is to provide a plasma display panel, a method of driving the same and a plasma display apparatus that can increase a number of gradations and brightness by addressing a plural display lines simultaneously to decrease the address period.

According to the first aspect of the present invention, there is provided a plasma display apparatus comprising: a plasma display panel having a substrate, electrodes X1 to Xn+1 formed at the substrate, electrodes Y1 to Yn formed at the substrate and address electrodes formed at the substrate or at another substrate facing the substrate at a distance, the electrodes X1 to Xn+1 being arranged in that order and parallel to one another, an electrode Yi being arranged between an electrode Xi and an electrode Xi+1 for each i=1 to n, the address electrodes being arranged with intersecting the electrodes X1 to Xn+1 and Y1 to Yn at a distance; and an electrode drive circuit; wherein the electrode drive circuit includes: first field addressing means, for i=1 to n, for causing a first address discharge to occur between the electrode Yi and the address electrodes selected in correspondence to display data in a first field of a frame and for causing a discharge to occur between the electrode Yi and the electrode Xi using the first address discharge as a trigger to generate a first wall charge required for a sustaining discharge in correspondence to the display data in the first field; first field sustaining means, after the first wall charge having been generated and for odd number o among 1 to n and for even number e among 1 to n, for supplying a first AC sustaining pulse between an electrode Yo and an electrode Xo and for supplying a second AC sustaining pulse between an electrode Ye and an electrode Xe; second field addressing means, for i=1 to n, for causing a second address discharge to occur between the electrode Yi and the address electrodes selected in correspondence to display data in a second field of the frame and for causing a discharge to occur between the electrode Yi and the electrode Xi+1 using the second address discharge as a trigger to generate a second wall charge required for a sustaining discharge in correspondence to the display data in the second field; and second field sustaining means, after the second wall charge having been generated and for odd number o among 1 to n and for even number e among 1 to n, for supplying a third AC sustaining pulse between the electrode Yo and the electrode Xo+1 and for supplying a fourth AC sustaining pulse between the electrode Ye and the electrode Xe+1.

With the first aspect of the present invention, since the display lines in odd-numbered field and the display lines in even-numbered fields can be made so as not to affect each another in regard to discharge, it is not necessary to provide partitioning walls along the central lines on the electrodes X1 to Xn+1 and electrodes Y1 to Yn of the plasma display panel. Thus, production of the plasma display panel is facilitated, reducing the production cost and, with the pixel pitch reduced, higher definition can be achieved.

In the first mode of the first aspect of the present invention, the first field sustaining means supplies the first and second AC sustaining pulses with ensuring that voltage waveforms applied to the electrodes Yo and Xe are of the same phase to each other, that voltage waveforms applied to the electrodes Ye and Xo are of the same phase to each other and that the first and second AC sustaining pulses are of the reverse phase to each other; and the second field sustaining means supplies the third and fourth AC sustaining pulses while ensuring that voltage waveforms applied to the electrodes Yo and Xo are of the same phase to each other, that voltage waveforms applied to the electrodes Ye and Xe are of the same phase to each other and that the third and fourth AC sustaining pulses are of the reverse phase to each other.

The first mode is effective since the display lines in odd-numbered field, and the display lines in even-numbered fields do not affect each other in regard to discharge.

In the second mode of the first aspect of the present invention, the first field addressing means, in a first period; applies a DC voltage to all odd-numbered electrodes among the electrodes X1 to Xn+1 and applies a pulse with a reverse polarity voltage against the DC voltage to the electrode Yo, and in a second period, applies the DC voltage to all even-numbered electrodes among the electrodes X1 to Xn+1 and applies a pulse with a reverse polarity voltage against the DC voltage to the electrode Ye; and the second field addressing means, in a third period, applies the DC voltage to all the even-numbered electrodes among the electrodes X1 to Xn+1 and applies a pulse with a reverse polarity voltage against the DC voltage to the electrode Yo, and in a fourth period, applies the DC voltage to all the odd-numbered electrodes among the electrodes X1 to Xn+1 and applies a pulse with a reverse polarity voltage against the DC voltage to the electrode Ye.

With the second mode, only one pulse with a large width need to be supplied to each of the odd-numbered group and the even-numbered group of the electrodes X1 to Xn+1 during each address period for the odd-numbered fields and the even-numbered fields. Thus, power consumption is reduced compared to a case in which the pulse must be supplied to those groups for every scanning of the electrodes Y1 to Yn. In addition, the structure of the electrode drive circuit can be simplified.

In the third mode of the first aspect of the present invention, the first field addressing means applies pulses with reverse polarity voltages to each other to the electrodes Yi and Xi when causing the discharge to occur between the electrode Yi and the electrode Xi; and the second field addressing means applies pulses with reverse polarity voltages to each other to the electrodes Yi and Xi+1 when causing the discharge to occur between the electrode Yi and the electrode Xi+1.

With the third mode, since only the required pulse is supplied to the electrodes X1 to Xn+1 during an address period, power consumption is reduced compared to a case in which pulses are commonly supplied to the odd-numbered group and the even-numbered group among the electrodes X1 to Xn+1.

In the fourth mode of the first aspect of the present invention, the first and second field addressing means includes: a first sustain circuit for outputting a first voltage-waveform of a DC pulse train; a second sustain circuit for outputting a second voltage-waveform with its phase offset by 180° from a phase of the first voltage-waveform; a switching circuit having switching elements for selectively supplying either the first or second voltage-waveform to the electrodes Yo, Ye, Xo and Xe; and a control circuit for controlling the switching elements of the switching circuit in such a way that the first voltage-waveform is supplied to the electrodes Yo and Xe and the second voltage-waveform is supplied to the electrodes Ye and Xo after the first wall charge having been generated and that the first voltage-waveform is supplied to the electrodes Ye and Xe after the second wall charge has been generated.

With the fourth mode, since the voltage-waveforms from the first sustain circuit and the second sustain circuit are selectively supplied to the electrodes Yo, Ye, Xo and Xe, the structure of the electrode drive circuit is simplified.

In the fifth mode of the first aspect of the present invention, both the first field and the second field consist of a plurality of subfields with numbers of sustaining discharge pulses different from one another, and the electrode drive circuit further comprising: first field reset means, prior to the first address discharge in a first subfield of the first field and for i=1 to n, for causing a discharge to occur between the electrode Yi and the electrode Xi and between the electrode Yi and the electrode Xi+1 in order to eliminate wall charge for all pixels or to generate wall charge for all pixels; and prior to the first address discharge in the rest subfields of the first field and for odd number o among 1 to n and for even number e among 1 to n, for causing a discharge D1 to occur between the electrode Yo and the electrode Xo and a discharge D2 to occur between the electrode Ye and the electrode Xe with a time lag from the discharge D1 in order to eliminate or generate wall charge only for pixels in the first field; and second field reset means, prior to the second address discharge in a first subfield of the second field and for i=1 to n, for causing a discharge to occur between the electrode Yi and the electrode Xi and between the electrode Yi and the electrode Xi+1 in order to eliminate wall charge for all pixels or to generate wall charge for all pixels; and prior to the second address discharge in the rest of the subfields of the second field and for odd number o among 1 to n and for even number e among 1 to n, for causing a discharge D3 to occur between the electrode Yo and the electrode Xo+1 and a discharge D4 to occur between the electrode Ye and the electrode Xe+1 with a time lag from the discharge D3 in order to eliminate or generate wall charge only for pixels in the second field.

With the fifth mode, since unwanted light emission is reduced, the brightness of black display is lowered to improve the black display quality.

In the sixth mode of the first aspect of the present invention, each of the electrodes X1 to Xn+1 and Y1 to Yn includes: a transparent electrode formed at the substrate; and a metal electrode formed at the transparent electrode along the central line of the transparent electrode with a width smaller than the transparent electrode.

With the sixth mode, the structure of each display line is made identical.

According to the second aspect of the present invention, there is provided a plasma display apparatus comprising: a plasma display panel having a substrate, electrodes X1 to X2n formed at the substrate, electrodes Y1 to Yn formed at the substrate and address electrodes formed at the substrate or at another substrate facing the substrate at a distance, electrodes Xo, Yi and Xe being arranged in that order parallel to one another, where o=2i−1, e=2i and i=1 to n, the address electrodes being arranged with intersecting the electrodes X1 to X2n and Y1 to Yn at a distance; and an electrode drive circuit; wherein the electrode drive circuit includes: odd-numbered flame addressing means, for o=2i−1 and i=1 to n, for causing a first address discharge to occur between the electrode Yi and the address electrodes selected in correspondence to display data in an odd-numbered flame and for causing a discharge to occur between the electrode Yi and the electrode Xo using the first address discharge as a trigger to generate a first wall charge required for a sustaining discharge in correspondence to the display data in the odd-numbered frame; odd-numbered frame sustaining means, for o=2i−1 and i=1 to n, for supplying a first AC sustaining pulse between the electrode Yi and the electrode Yo after the first wall charge having been generated; even-numbered flame addressing means, for e=2i and i=1 to n, for causing a second address discharge to occur between the electrode Yi and the address electrodes selected in correspondence to display data in an even-numbered frame and for causing a discharge to occur between the electrode Yi and the electrode Xe using the second address discharge as a trigger to generate a second wall charge required for a sustaining discharge in correspondence to the display data in the even-numbered frame; and even-numbered frame sustaining means, for e=2i and i=1 to n, for supplying a second AC sustaining pulse between the electrode Yi and the electrode Ye after the second wall charge having been generated.

With the 2nd aspect of the present invention, since the display lines in the odd-numbered frames and the display lines in the even-numbered frames can be made not to affect each other in regard to discharge, it is not necessary to provide partitioning walls along the central lines of the electrodes Xo, Yi and Xe of the plasma display panel. Thus, production of the plasma display panel is facilitated, reducing the production cost and allowing reduced pixel pitch, which supports higher definition.

Also, since two display lines are formed with three parallel electrodes, the pixel pitch can be reduced compared to the prior art structure in which two display lines are formed with four parallel electrodes, making it possible to achieve higher definition. In addition, since it is not necessary to divide the electrodes Y1 to Yn into even and odd numbered groups, the structure is simplified.

Moreover, with frame interlaced scanning, the address period can be reduced by half compared to that with non-interlaced scanning, lengthening the period of sustaining discharge. This makes it possible to achieve a higher number of gradations by increasing the number of sub frames or makes it possible to achieve higher brightness by increasing the number of times sustaining discharge is performed.

In the first mode of the second aspect of the present invention, the electrodes Xo, Yi and Xe have substantially symmetrical forms relative to a central line of the electrode Yi; each of the electrodes have a transparent electrode formed at the substrate, and a metal electrode formed at the transparent electrode at a width smaller than that of the transparent electrode; and the metal electrodes of the electrodes Xo and Xe are arranged on sides away from the electrode Yi.

With the first mode, since, when a voltage is supplied between the electrodes Xo and Yi for instance, the electric field above the electrode Xo becomes more intense on the metal electrode side, the pixel area can be increased essentially compared to a case in which the metal electrode is formed along the central line on the transparent electrode, even if the electrode pitch is reduced to achieve higher definition. This does not present any problem, since the sides of the electrodes Xo and Xe, which are opposite to the electrode Yi, are non display lines, and as the non display lines can be narrowed essentially, this is desirable.

In the second mode of the second aspect of the present invention, the electrodes Xo, Yi and Xe have substantially symmetrical forms relative to a central line of the electrode Yi; the electrode Yi is a metal electrode formed at the substrate; each electrode Xo and the electrode Xe has a transparent electrode formed at the substrate, and a metal electrode formed at the transparent electrode at a width smaller than that of the transparent electrode; and the metal electrodes of the electrodes Xo and Xe are arranged on sides away from the electrode Yi.

With the second mode, since the width of the electrode Yi become small, the power consumption of supplying scanning pulses to the electrode Yi is reduced. In addition, it is possible to further reduce the pixel pitch.

In the third aspect of the present invention, there is provided a plasma display panel comprising a substrate sustaining electrodes, for sustaining discharge, formed in parallel to one another at the substrate and address electrodes formed at the substrate or at another substrate facing the substrate at a distance, the address electrodes being arranged intersecting the sustaining electrodes at a distance in parallel to one another, the plasma display panel further comprising a light blocking member at a non display line between adjacent electrodes of the sustaining electrodes.

With the third aspect, by employing the light blocking member, reduction of the black display quality caused by discharge light emission at the non display line can be decreased.

In the first mode of the second aspect of the present invention, the address electrodes are covered with phosphor, and an observer-side surface of the light blocking member has darker color than the phosphor.

With the first mode, since incident light from the outside to the phosphor at the non display line is absorbed by the light blocking member, the contrast of an image on the PDP in bright place increases more than a case that incident light from the outside to the phosphor at the non display line is reflected and enters eyes of an observer.

In the fourth aspect of the present invention, there is provided a plasma display apparatus comprising: a plasma display panel having a substrate, electrodes X1 to Xn formed at the substrate, electrodes Y1 to Yn formed at the substrate, address electrodes formed at the substrate or at another substrate facing the substrate at a distance and a light blocking member between electrodes Yi and Xi+1, where i=1 to n−1, electrodes Xi and Yi being arranged by turns in parallel, where i=1 to n; and an electrode drive circuit; wherein the electrode drive circuit includes: reset means, for i=1 to n−1, for causing a discharge to occur between the electrode Yi and an electrode Xi+1 with ensuring that voltage waveforms applied to the electrodes Xi and Yi are in the same phase to each other and that voltage waveforms applied to the electrode Xn and the electrode Yn are in the same phase to each other in a reset period; addressing means, for i=1 to n, for causing an address discharge to occur between either the electrode Xi or Yi and the address electrode selected in correspondence to display data and causes a discharge to occur between the electrode Xi and electrode Yi using the address discharge as a trigger to generate a wall charge required for a sustaining discharge in correspondence to the display data in an address period after the reset period has elapsed; and sustaining means, for i=1 to n, for supplying an AC sustaining pulse between the electrode Xi and the electrode Yi in a sustain period after the address period has elapsed.

With the fourth aspect, by employing the light blocking member, reduction of the black display quality caused by light emission during a reset period can be decreased. Although the light blocking member will somewhat prevent achieving higher definition, in comparison to the structure in the prior art shown in FIG. 30, since it is not necessary to form the partitioning walls 191 to 196, production is facilitated and the pixel pitch can be further reduced.

In the fifth aspect of the present invention, there is provided a plasma display panel comprising a substrate, address electrode bundles formed along to one another at the substrate and scanning electrodes, for causing a discharge between the address electrode bundles and the scanning electrodes to generate a wall charge required for a sustaining discharge in correspondence to display data, the scanning electrodes intersecting the address electrode bundles at a distance, wherein each of the address electrode bundles includes: m (m≧2) number of address electrodes formed along to one another at the substrate in correspondence to one monochromatic pixel column; pads arranged along a lengthwise direction of the address electrodes corresponding to each monochromatic pixel, the pads being above the m number of address electrodes relative to the substrate; and contacts for connecting one pad to one of the address electrodes in a regular manner along the lengthwise direction of the address electrodes.

In the fifth aspect, by selecting m number of the scanning electrodes intersecting the pads connected to the m number of address electrodes simultaneously; and by applying voltages corresponding to display data to the m number of address electrodes simultaneously; scanning of the scanning electrodes is executed in units of m lines.

With the fifth aspect, a plurality of lines can be addressed at the same time, reducing the address period and, because of this, a higher number of gradations becomes possible by increasing the number of subfields or it becomes possible to achieve higher brightness by increasing the number of times sustaining discharge is performed.

DESCRIPTION OF THE PREFERRED EMBODIMENTS

Figure 1:
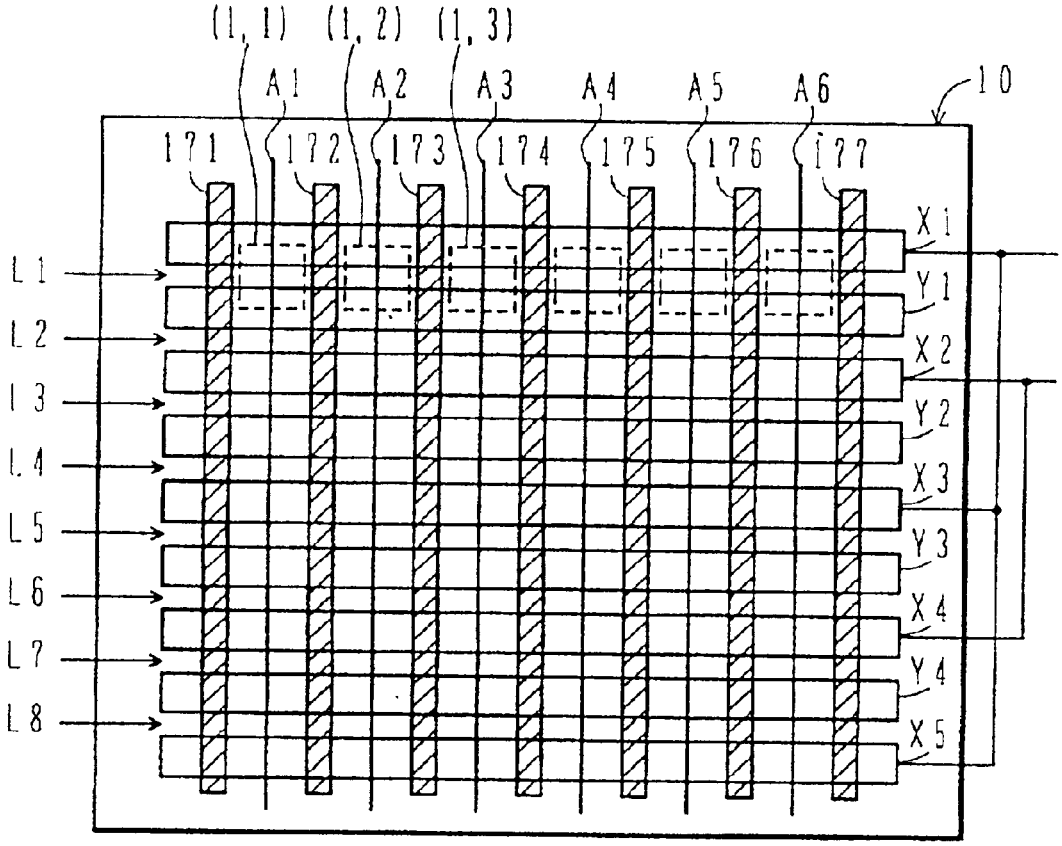
FIG. 1 is a schematic view showing a structure of a surface discharge PDP in the first embodiment according to the present invention.

Referring now to the drawings, wherein like reference characters designate like or corresponding parts throughout several views, preferred embodiments of the present invention are described below.

First Embodiment

FIG. 1 shows a PDP 10 in the first embodiment according to the present invention. In FIG. 1, pixels are indicated with dotted lines only for display line L1. In order to simplify the explanation, the number of pixels of the PDP 10 is 6×8=48 monochromatic pixels. The present invention may be applied to both color and monochromatic pixels and three monochromatic pixels corresponds to one color pixel.

Figure 31:
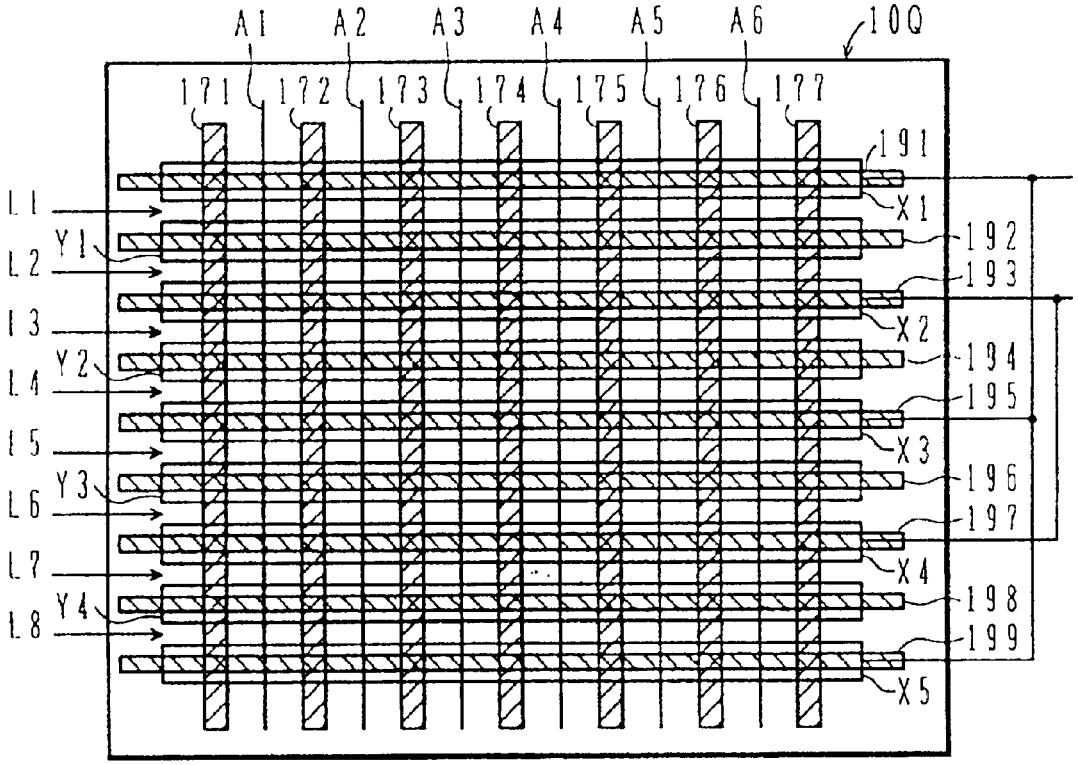
FIG.31 PRIOR ART
FIG. 31 shows a schematic structure of another surface discharge PDP in the prior art.

In order to facilitate production and to achieve higher definition by reducing the pixel pitch, the PDP 10 has a structure in which the partitioning walls 191 to 199 in the PDP 10Q in FIG. 31 are removed. In order to ensure that erroneous discharge does not occur among adjacent display lines due to the removal of the partitioning walls, interlaced scanning is performed in such a manner that the phases of the waveforms of the sustaining pulse voltages in the odd-numbered lines and in the even-numbered lines among the electrodes L1 to L8, which perform surface discharge and will be explained later, are reversed from each other (in the prior art interlaced scanning, since lines L2, L4, L6 and L8 are non-display lines, lines L1 and L5 are scanned in odd-numbered fields and the lines L3 and L7 are scanned in even-numbered fields).

Figure 2:
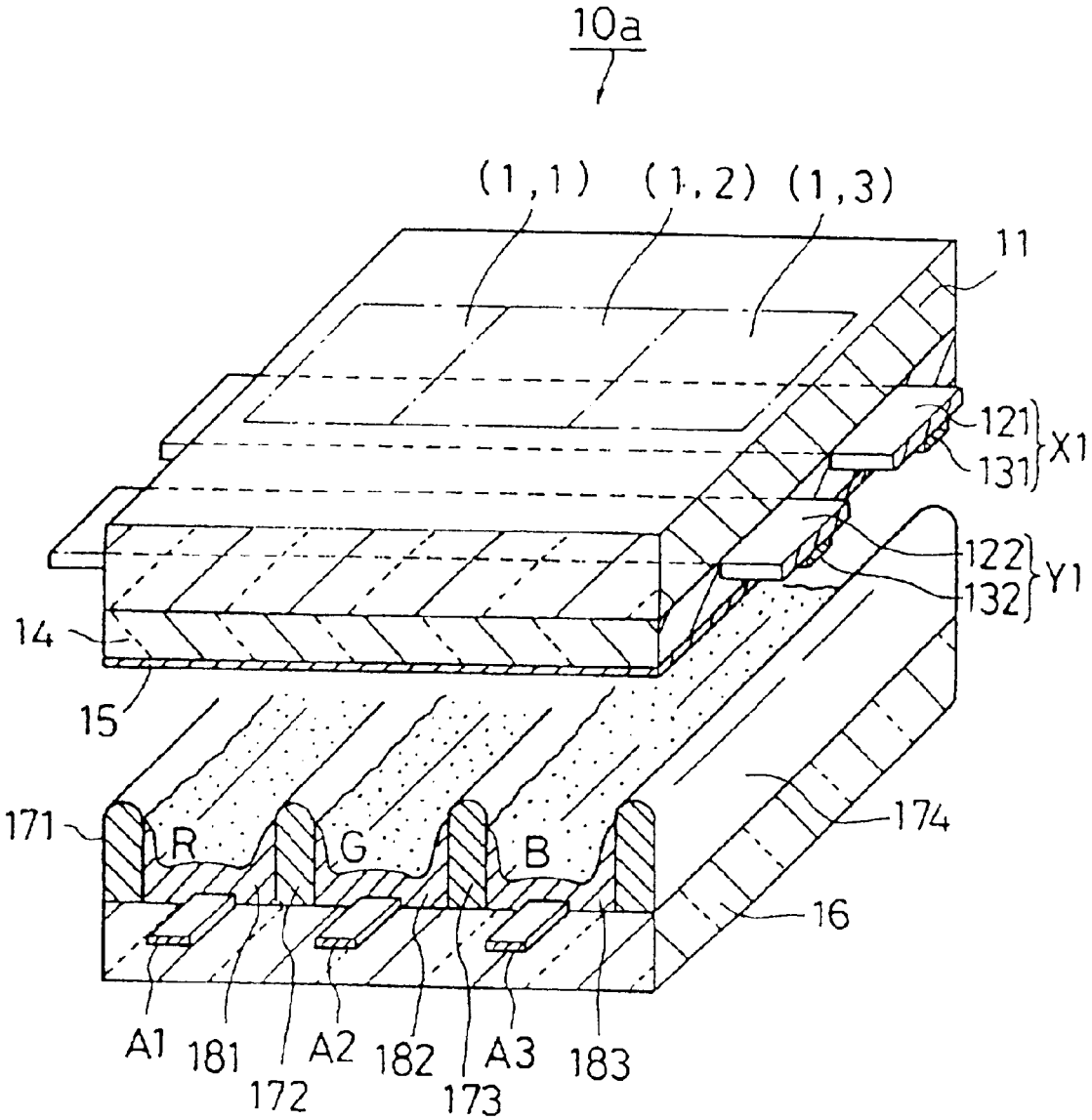
FIG. 2 is a perspective view showing a state in which the area between the opposite surfaces of the color pixels in the PDP shown in FIG. 1 is expanded.
Figure 3:
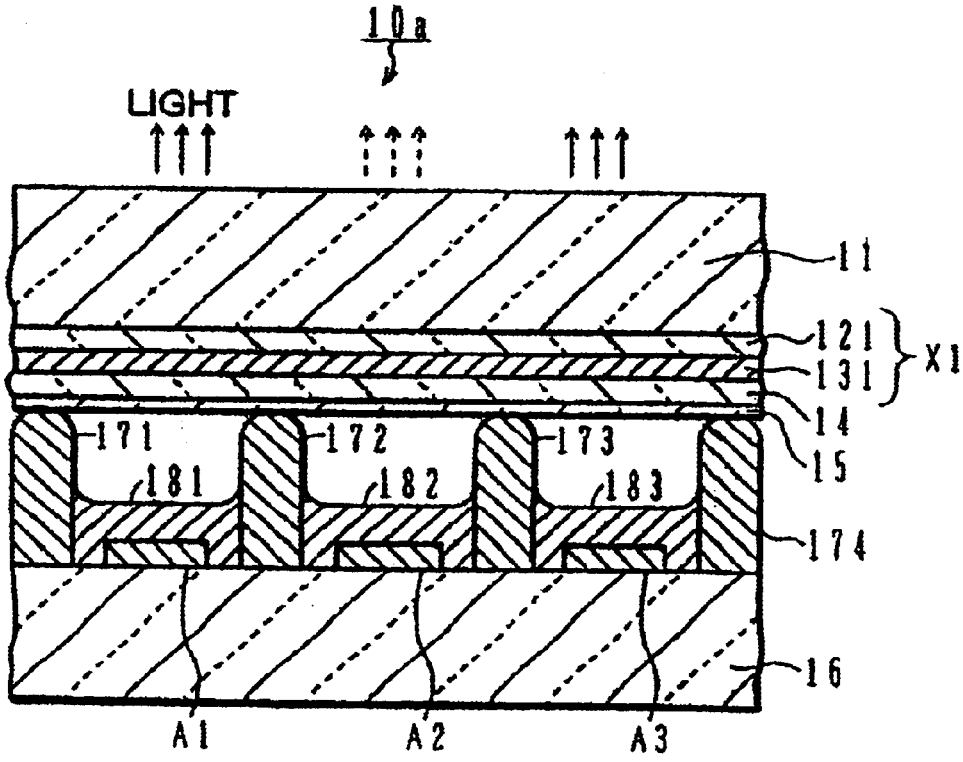
FIG. 3 is a longitudinal cross sectional view of a color pixel of the PDP shown in FIG. 1 along an electrode X1.

FIG. 2 shows a state in which the distance between the opposite surfaces of a color pixel 10A is expanded. FIG. 3 shows a longitudinal cross section of the color pixel 10A along an electrode X1.

On one surface of a glass substrate 11 as a transparent substrate of insulator, transparent electrodes 121 and 122, constituted with IT0 film or the like, are provided parallel to each other and, in order to minimize the reduction in voltage in the transparent electrodes 121 and 122 along the lengthwise direction, metal electrodes 131 and 132, constituted with copper or the like, are formed along the central lines of the transparent electrodes 121 and 122 respectively. The transparent electrode 121 and the metal electrode 131 constitute the electrode X1 and the transparent electrode 122 and the metal electrode 132 constitute an electrode Y1. A dielectric substance 14 for holding the wall charge covers the glass substrate 11 and the electrodes X1 and Y1. The dielectric substance 14 is covered with an MgO protective film 15.

On the surface of a glass substrate 16, which faces the MgO protective film 15, address electrodes A1, A2 and A3 are formed in the direction which runs at a right angle to the electrodes X1 and Y1, with partitioning walls 171 to 173 partitioning them. A phosphor 181 which emits red light, a phosphor 182 which emits green light and a phosphor 183 which emits blue light when ultraviolet light generated during discharge enters them, cover the areas between the partitioning wall 171 and the partitioning wall 172, between the partitioning wall 172 and the partitioning wall 173 and between the partitioning wall 173 and the partitioning wall 174 respectively. The discharge space between the phosphors 181 to 183 and the MgO protective film 15 is filled with Ne+Xe Penning mixed gas, for instance.

The partitioning walls 171 to 174 prevent the ultraviolet light generated during a discharge from entering adjacent pixels and also function as spacers for forming the discharge space. If the phosphors 181 to 183 are constituted with an identical substance, the PDP 10 will be a monochromatic display.

Figure 4:
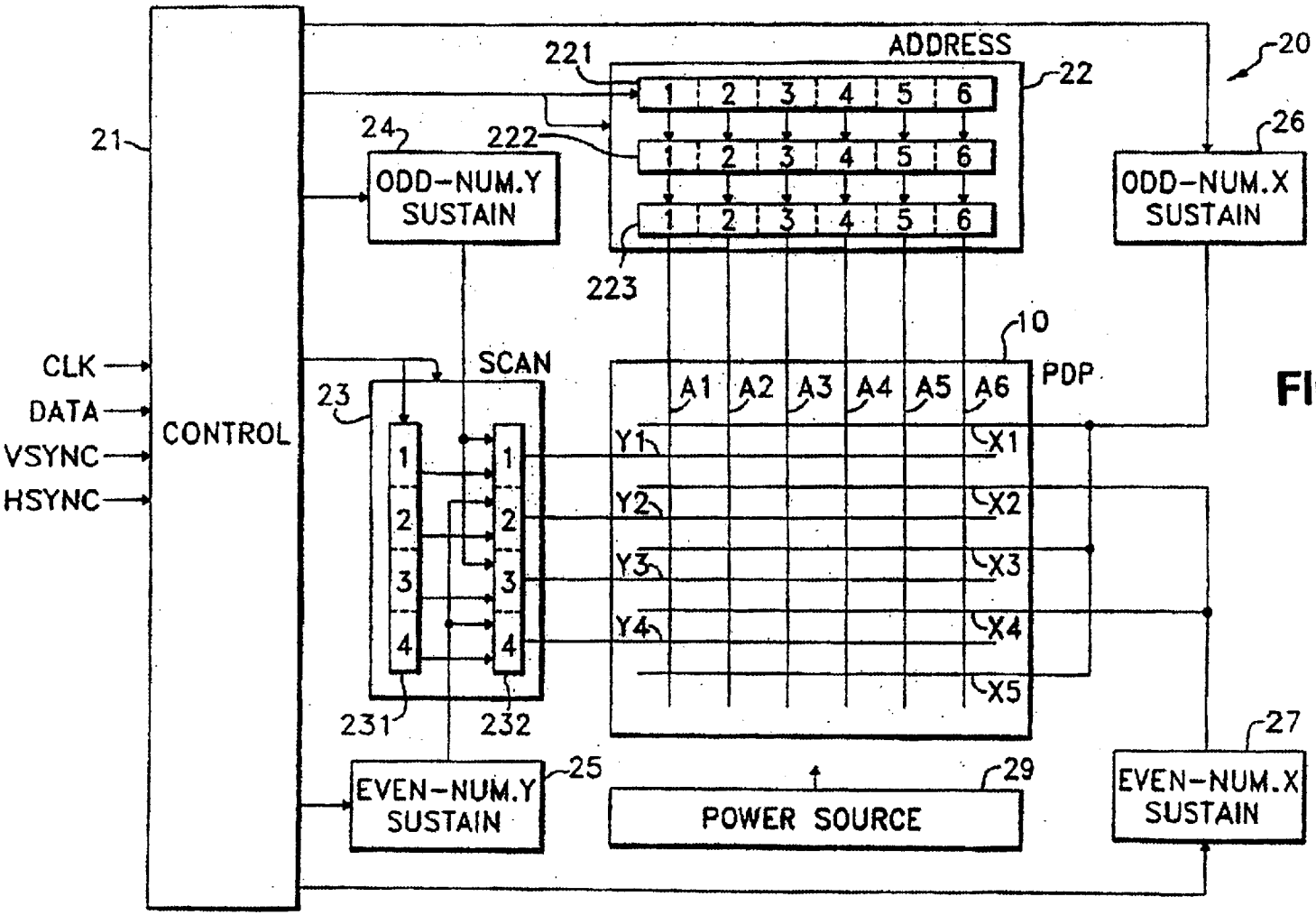
FIG. 4 is a block diagram showing the schematic structure of a plasma display apparatus in the first embodiment according to the present invention.

FIG. 4 shows the schematic structure of a plasma display apparatus 20 which employs the PDP 10 structured as described above.

A control circuit 21 converts the display data DATA supplied from the outside to data for the PDP 10, supplies them to a shift register 221 of an address circuit 22 and, based upon a clock signal CLK, a vertical synchronization signal VSYNC and a horizontal synchronization signal HSYNC provided from the outside, generates various control signals which are provided to components 22 to 27.

Figure 7:
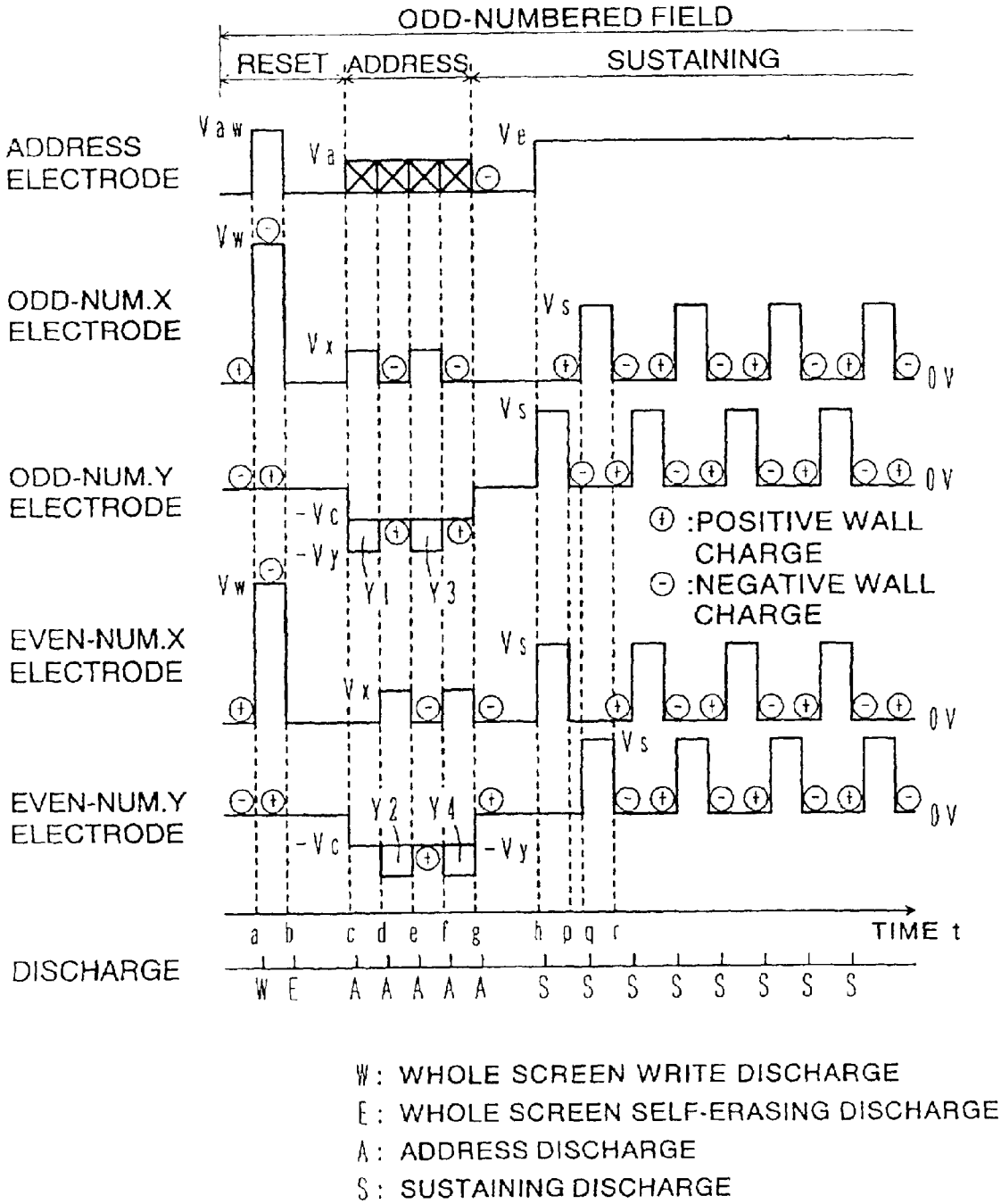
FIG. 7 is a waveform diagram of voltages applied to electrodes in an odd-numbered field, for illustrating a method of driving the PDP in the first embodiment according to the present invention.
Figure 8:
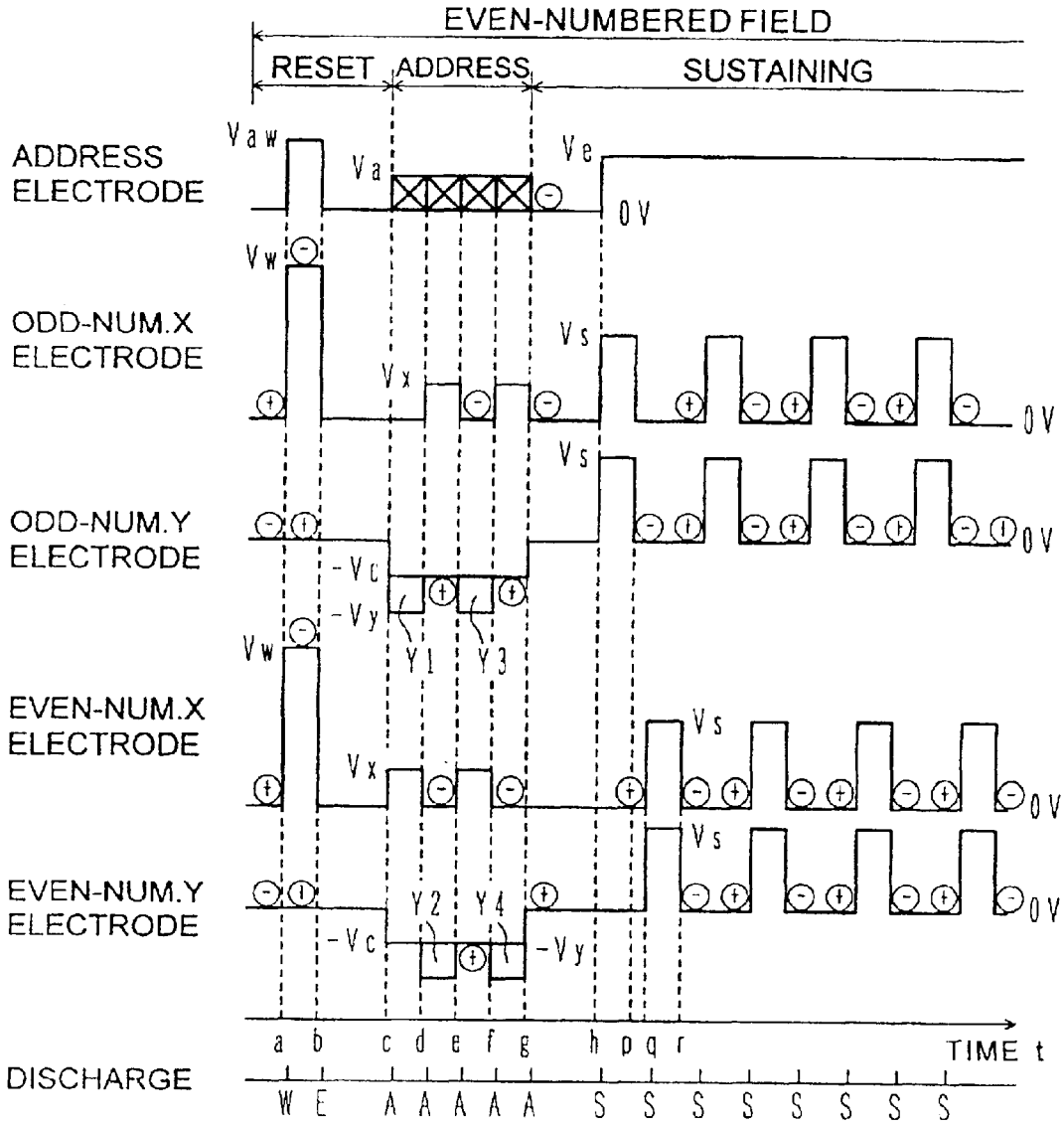
FIG. 8 is a waveform diagram of voltages applied to electrodes in an even-numbered field, for illustrating the method of driving the PDP in the first embodiment according to the present invention.

In order to apply the voltages with the waveforms shown in FIGS. 7 and 8 to the electrodes, voltages Vaw, Va and Ve are supplied to the address circuit 22 and voltages −Vc, −Vy and Vs are supplied to an odd-numbered Y sustain circuit 24 and an even-numbered Y sustain circuit 25, and voltages Vw, Vx and Vs are supplied to an odd-numbered X sustain circuit 26 and an even-numbered X sustain circuit 27, from a power source circuit (power supply circuit) 29.

The numerical values inside the shift register 221 shown in FIG. 4, are used to identify elements which are structured identically to each other and, for instance, 221(3) indicates the third bit of the shift register 221. The same applies to other component elements.

In the address circuit 22, when display data corresponding to one line have been supplied serially to the shift register 221 from the control circuit 21 during an address period, bits 221(1) to 221(6) are held in bits 222(1) to 222(6) respectively of a latch circuit 222, and in correspondence to their values, switching elements (not shown) inside drivers 223(1) to 223(6) are ON/OFF controlled and a binary voltage pattern whereby the voltage is either Va or 0V is supplied to the address electrodes A1 to A6.

A scanning circuit 23 is provided with shift registers 231 and drivers 232. During an address period, "1" is supplied to a serial data input of the shift registers 231 for the initial address cycle only in each VSYNC cycle and then it is shifted in synchronization with the address cycle. ON/OFF control is performed for switching elements (not shown) in the drivers 232(1) to 232(6) with the values of the bits 231(1) to 231(4) in the shift register 231 and the selected voltage −Vy or the unselected voltage −Vc is applied to the electrodes Y1 to Y4. In other words, the electrodes Y1 to Y4 are sequentially selected by the shifting operation of the shift register 231 and the selected voltage −Vy is applied to the selected electrodes Y and the unselected voltage −Vc is applied to the electrodes Y which have not been selected. These voltages −Vy and −Vc are supplied from the odd-numbered Y sustain circuit 24 and the even-numbered Y sustain circuit 25. During a sustain period, a first sustaining pulse train is supplied from the odd-numbered Y sustain circuit 24 to the odd-numbered electrodes Y1 and Y3 of the Y electrodes via the drivers 232(1) and 232(3) and a second sustaining pulse train whose phase is shifted by 180° from the that of first sustain pulse train is supplied from the even-numbered Y sustain circuit 25 to the even-numbered electrodes Y2 and Y4 of the Y electrodes via the drivers 232(2) and 232(4).

In the circuit for the X electrodes, during the sustaining period, the second sustaining pulse train is supplied from the odd-numbered X sustain circuit 26 to the odd-numbered electrodes X1, X3 and X5 of the X electrodes and the first sustaining pulse train is supplied from the even-numbered X sustain circuit 27 to the even-numbered electrodes X2 and X4 of the X electrodes. During a reset period, a whole-screen (all pixel) write pulse is commonly supplied to the electrodes X1 to X5 from the X sustain circuits 26 and 27 respectively. During an address period, in correspondence to the scan pulses, a pulse train for two address cycles is supplied to the odd-numbered electrodes X1, X3 and X5 of the X electrodes from the odd-numbered X sustain circuit 26, and a pulse train whose phase is shifted by 180° from the aforementioned pulse train, is supplied to the even-numbered electrodes X2 and X4 of the X electrodes from the even-numbered X sustain circuit 27.

The above-described circuits 223, 232, 24, 25, 26 and 27 are switching circuits for switching on/off voltages supplied from a power source circuit 29.

Figure 5:
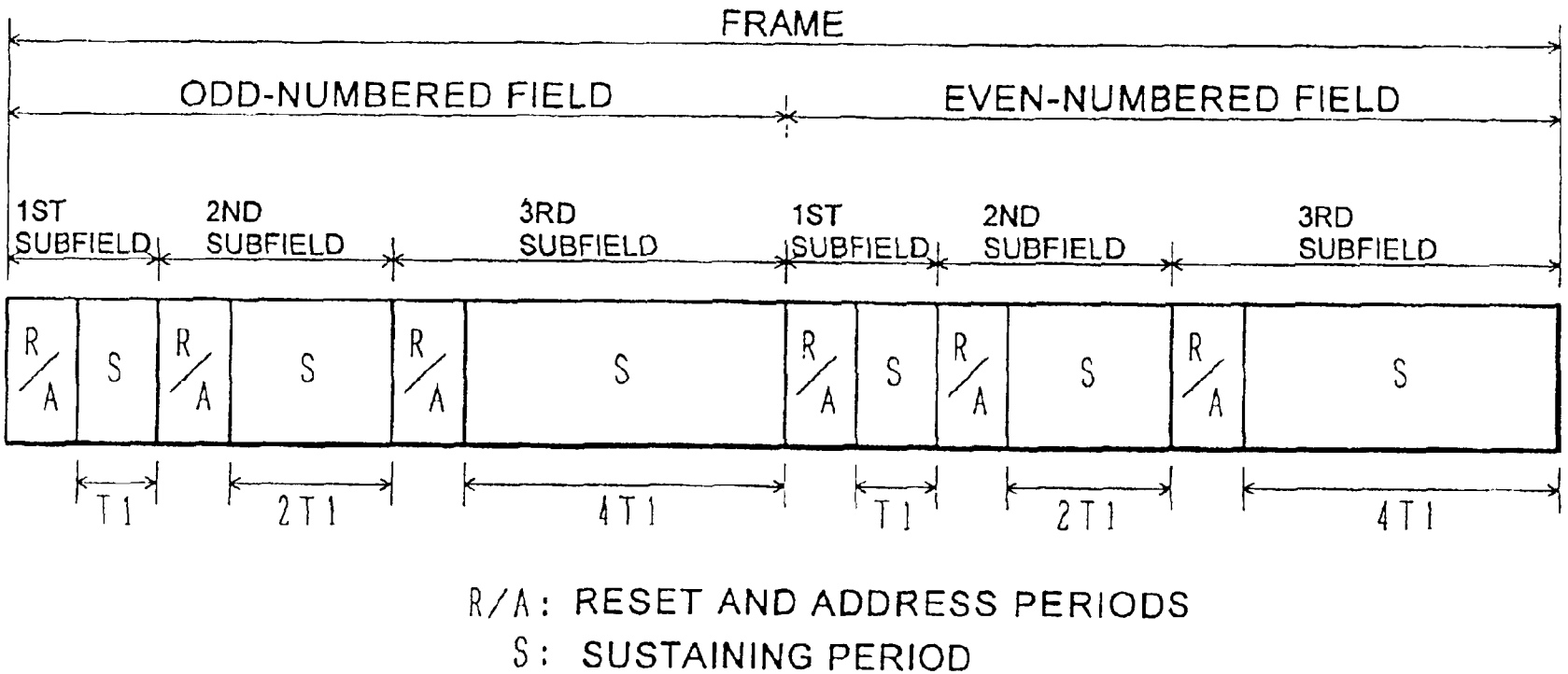
FIG. 5 shows the structure of a frame.

FIG. 5 shows the structure of one frame of the display image.

This frame is divided into two fields, i.e., an even-numbered field and an odd-numbered field and each field consists of first to third subfields. For each subfield, voltages with the waveforms shown in FIG. 7 are supplied to the various electrodes of the PDP 10 in odd-numbered field to display lines L1, L3, L5 and L7 shown in FIG. 1, and voltages with the waveforms shown in FIG. 8 are supplied to the various electrodes of the PDP 10 in the even-numbered field to display lines L2, L4, L6 and L8 shown in FIG. 1. The sustaining periods in the first to third subfields are T1, 2T1 and 4T1 respectively and in each subfield, sustaining discharge is performed a number of times that corresponds to the length of the sustaining period. With this, the brightness will have eight gradations. Likewise, with the number of subfields at 8 and the ratio of the sustain periods at 1:2:4:8:16:32:64:128, the brightness will have 256 gradations.

Figure 6A:
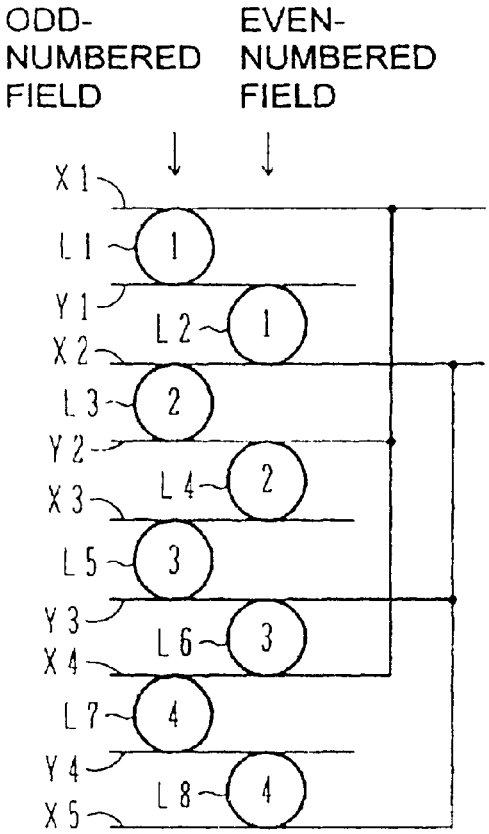
FIGS. 6(A) and 6(B) show the order in which display lines are scanned during an address period.

The scanning of the display lines during an address period is performed in the order of the numbers assigned inside the circles in FIG. 6(A). Namely, for the odd-numbered field, scanning is performed in the order of the display lines L1, L3, L5 and L7 and for the even-numbered field, scanning is performed in the order of the display lines L2, L4, L6 and L8.

Next, the operation in the odd-numbered field is explained in reference to FIG. 7. W, E, A and S in FIG. 7 respectively indicate time points at which whole-screen write discharge, whole-screen self-erasing discharge, address discharge and sustaining discharge occur. Hereafter, for the sake of simplification, the following general terms are used;

X electrodes: electrodes X1 to X5

Odd-numbered X electrodes: electrodes X1, X3 and X5

Even-numbered X electrodes: electrodes X2 and X4

Y electrodes: electrodes Y1 to Y4

Odd-numbered Y electrodes: electrodes Y1 and Y3

Even-numbered Y electrodes: electrodes Y2 and Y4

Address electrodes: address electrodes A1 to A6 also,

Vfxy: discharge start voltage between adjacent X electrodes and Y electrodes,

Vfay: discharge start voltage between address electrodes and Y electrodes that face each other, Vwall: voltage between a positive wall charge and a negative wall charge due to the wall charge generated by discharge between adjacent X electrodes and Y electrodes (wall voltage)

For instance, Vfxy=290V and Vfay=180V. In addition, the areas between address electrodes and Y electrodes are referred to as the areas between A–Y electrodes and this reference system applies to the areas between other electrodes.

(1) Reset Period

During a reset period, the waveforms of the voltages supplied to the X electrodes, which are whole-screen write pulses, are identical to one another, the waveforms of the voltages supplied to the Y electrodes are identical to one another at 0V and the waveforms of the voltages supplied to the address electrodes, which are intermediate voltage pulses, are identical to one another.

At the beginning, the voltage applied to each electrode is set at 0V. Because of the last sustaining pulse of the sustain period before the reset period, positive wall charges are present on the MgO protective film 15 near the X electrodes (on the X-electrode sides) and negative wall charges are present on the MgO protective film 15 near the Y electrodes (on the Y-electrode sides), for the pixels that are lit. Hardly any wall charge is present on the X-electrode sides or the Y-electrode sides for the pixels that are not lit.

While a≦t≦b, a reset pulse at the voltage Vw is supplied to the X electrodes and an intermediate voltage pulse at the voltage Vaw is supplied to the address electrodes. For instance, Vw=310V and Vw>Vfxy. Regardless of whether or not there is any wall charge, whole-screen write discharge W is generated between adjacent X–Y electrodes, i.e., between the X–Y electrodes for the display lines L1 to L8. The resulting electrons and positive ions are attracted by the electric fields caused by the voltage Vw between the X–Y electrodes to generate a wall charge of reverse polarity. This reduces the strength of the electric field in the discharge space to terminate the discharge in 1 to several μs. The voltage Vaw is approximately Vw/2 and since the absolute values of the voltage between the A–X electrodes and the voltage between the A–Y electrodes, whose phases are reversed from each other, are almost equal to each other, the average wall charge remaining in the phosphors due to the discharge is approximately 0.

When the reset pulse falls at t=b, i.e., when the applied voltage with a reverse polarity from the wall voltage dissipates, the wall voltage Vwall between the X–Y electrodes becomes larger than the discharge start voltage Vfxy, to cause a whole-screen self-erasing discharge E. At this time, since the X electrodes, the Y electrodes and the address electrodes are all at 0V, almost no wall charge is generated by this discharge and the ions and the electrons are reunited within the discharge space and almost completely neutralized in the space. Some residual floating charge may remain, but this floating space charge functions as a priming fire, which induces discharge more easily during the next address discharge. This is known as the priming effect.

(2) Address Discharge Period

During an address period, the waveforms of the voltages supplied to the odd-numbered X electrodes are identical to one another, the waveforms of the voltages supplied to the even-numbered X electrodes are identical to one another, and the waveforms of the voltages supplied to the unselected Y electrodes are identical to one another with the voltage at −Vc. The Y electrodes are selected in order of Y1 to Y4 and the scanning pulse at voltage −Vy is supplied to the selected electrodes while the voltage at the unselected electrodes is set to −Vc. For instance, Vc=Va=50V, Vy=150V.

(c≦t≦d) A scanning pulse at the voltage −Vy is supplied to the electrode Y1 and a write pulse at the voltage Va is supplied to each of the address electrodes for the pixels that are to be lit.

The following relationship:

$$Va+Vy>Vfay$$

is satisfied and address discharge only occurs for the pixels to be lit, and the discharge ends by a generated wall-charge with a reverse polarity. During this address discharge, a pulse at voltage Vx is supplied only to the electrode X1 of the electrodes X1 and X2 which are adjacent to the electrode Y1. If the discharge start voltage between the X–Y electrodes, triggered by this address discharge, is designated Vxyt, the following relationship:

$$Vx+Vc<Vxyt<Vx+Vy<Vfxy$$

is satisfied and a write discharge occurs between the X1–Y1 electrodes in the display line L1. Then, the discharge ends by a generated wall-charge, insufficient to cause self discharge, with a reverse polarity between the X1–Y1 electrodes. On the other hand, write discharge does not occur between the X2–Y1 electrodes in the display line L2.

(d≦t≦e) A scanning pulse at the voltage −Vy is supplied to the electrode Y2, a pulse at the voltage Vx is supplied to the even-numbered X electrodes and a write pulse at the voltage Va is supplied to the address electrodes for the pixels to be lit. With this, in the same manner as described above, a write discharge occurs between the X2-Y2 electrodes in the display line L3 to generate a wall charge with reverse polarity, whereas no discharge occurs between the X3–Y2 electrodes in the display line L4.

Subsequently, operation identical to that described above is performed with e≦t≦g.

Thus, a write discharge of display data occurs for the pixels to be lit in the order of the display lines L1, L3, L5 and L7, a positive wall charge is generated on the Y-electrode sides and a negative wall charge is generated on the X-electrode sides.

(3) Sustain Period

During a sustain period, a sustaining pulse with the same phase and at the same voltage Vs is cyclically, or the first sustaining pulse train is supplied to the odd-numbered X electrodes and the even-numbered Y electrodes, and a second sustaining pulse train which is generated by shifting the phase of the first sustaining pulse train by 180° (½ cycle) is supplied to both the even-numbered X electrodes and the odd-numbered Y electrodes. In addition, in synchronization with the rise of the first sustaining pulse, the voltage Ve is supplied to the address electrodes, which are sustained until the sustain period ends.

(h≦t≦p) A sustaining pulse at the voltage Vs is supplied to the odd-numbered Y electrodes and the even-numbered X electrodes. The effective voltage of a pixel between the odd-numbered Y electrode and the odd-numbered X electrode is Vs+Vwall, the effective voltage of a pixel between the even-numbered Y electrode and the even-numbered X electrode is Vs−Vwall and the effective voltages of a pixel between the odd-numbered X electrode and the even-numbered Y electrode and a pixel between the even-numbered X electrode and the odd-numbered Y electrode are 2 Vwall. The following relationships:

$$Vs<Vfxy<Vs+Vwall,\ 2Vwall<Vfxy$$

are satisfied, a sustaining discharge occurs between the odd-numbered Y electrodes and the odd-numbered X electrodes and a wall charge with reverse polarity is generated to end the discharge. Sustaining discharge does not occur between other electrodes. As a result, display is effective only in the odd-numbered display lines L1 and L5 within the odd-numbered field. Only this time, the sustaining discharge between the even-numbered Y electrodes and the even-numbered X electrodes does not occur.

A sustaining pulse at the voltage Vs is supplied to the odd-numbered X electrodes and the even-numbered Y electrodes. Thereby, as is clear from FIGS. 4 and 7, a capacitor having X1 and Y1 electrodes is charged with a current from the odd-numbered X sustain circuit 26 to the X1 electrode and a current flows from the X1 electrode to the Y1 electrode. Simultaneously, a capacitor having Y2 and X2 electrodes is charged with a current from the even-numbered Y sustain circuit 25 to the Y2 electrode and a current flows from the Y2 electrode to the X2 electrode. Accordingly, the direction of the current on the Y1 electrode is opposite to that of the current on the X2 electrode, resulting in decreasing electric noise generation.

The effective voltages of a pixel between the odd-numbered X electrode and the odd-numbered Y electrode and a pixel between the even-numbered Y electrode and the even-numbered X electrode are both Vs+Vwall whereas the effective voltages of a pixel between the odd-numbered Y electrode and the even-numbered X electrode and a pixel between the odd-numbered X electrode and the even-numbered Y electrode are zero. That is the sustaining pulses applied on the Y1 and X2 electrodes are in the same phase and the sustaining pulses applied on the X3 and Y2 electrodes are in the same phase. With this, sustaining discharge occurs at a time S as shown in FIG. 7 after a front pulse edge at time h between the odd-numbered X electrodes and the odd-numbered Y electrodes and between the even-numbered Y electrodes and the even-numbered X electrodes, a wall charge with reverse polarity is generated to end the discharge. At the sustaining discharge, it is clear from FIGS. 4 and 7 that the gas-discharge currents occur from the X1 electrode to the Y1 electrode and from the Y2 electrode to the X2 electrode.

Sustaining discharge does not occur between other electrodes. Consequently, display of all the display odd-numbered lines L1, L3, L5 and L7 in the odd-numbered field becomes effective at once.

Subsequently, the sustaining discharge is repeated in the manner described above. During this process, as is obvious when one looks at the wall charge shown in FIG. 7, the effective voltages of a pixel between the odd-numbered Y electrode and the even-numbered X electrode and a pixel between the odd-numbered X electrode and the even-numbered Y electrode in the undisplayed lines are zero. The last sustaining discharge during the sustain period is performed in such a manner that the polarity of the wall charge is in the initial state during the reset period described earlier.

Next, the operation in the even-numbered field is explained.

In FIG. 1, the display of the display lines L1, L3, L5 and L7 which are constituted with pairs of electrodes, the electrodes Y1 to Y4 and the electrodes X1 to X4 that are adjacent to the electrodes Y1 to Y4 toward the upper side in FIG. 1, are effective in the odd-numbered field, as explained above. In the even-numbered field, the display of the display lines L2, L4, L6 and L8 which are constituted with the electrodes Y1 to Y4 and the electrodes X2 to X5 that are adjacent to the electrodes Y1 to Y4 toward the lower side in FIG. 1, must be made effective. This is accomplished by reversing the roles of the electrodes X1 and X2 relative to the electrode Y1, reversing the roles of the electrodes X2 and X3 relative to be electrode Y2 and so forth. In other words, it is accomplished by reversing the waveforms of the voltages supplied to the odd-numbered X electrodes and the even-numbered X electrodes that are organized into groups. FIG. 8 shows the waveforms of the voltages applied to those electrodes in the even-numbered field.

The operation performed in the even-numbered field is clear from the explanation given so far and also in reference to FIG. 8. To sum up, during a reset period, a whole-screen write discharge W and a whole-screen self-erasing discharge E are performed, during an address period, the electrodes Y1 to Y4 are selected sequentially and a write discharge of display data is performed in the order of the display lines L2, L4, L6 and L8 and, during a sustaining period, a simultaneous sustaining discharge is repeated in these display lines L2, L4, L6 and L8.

According to the drive method in this first embodiment, since the display lines in the odd-numbered field and the display lines in the even-numbered field do not affect each other in regard to discharge, the PDP can be structured as shown in FIG. 1 by removing the partitioning walls 191 to 199 in the PDP 10Q in FIG. 31, facilitating the production of the PDP 10 with reduced production cost and achieving higher definition by reducing the pixel pitch.

Second Embodiment

Figure 6B:
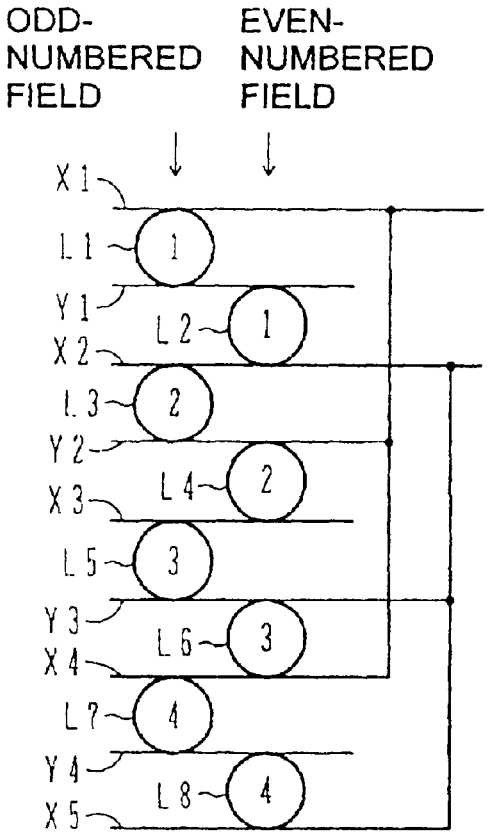

If the number of pulses can be reduced in FIGS. 7 and 8, power consumption can also be reduced. During an address period, if the pulses supplied to the odd-numbered X electrodes and the even-numbered X electrodes are made to be continuous, the number of pulses can be reduced. This can be achieved by performing scanning in the order shown in FIG. 6(B). To be more specific, the display lines L1, L3, L5 and L7 in the odd-numbered field should be further divided into odd-numbered lines and even-numbered lines and after scanning one group sequentially, the other group should be scanned sequentially. The same procedure is performed for the even-numbered field.

Figure 9:
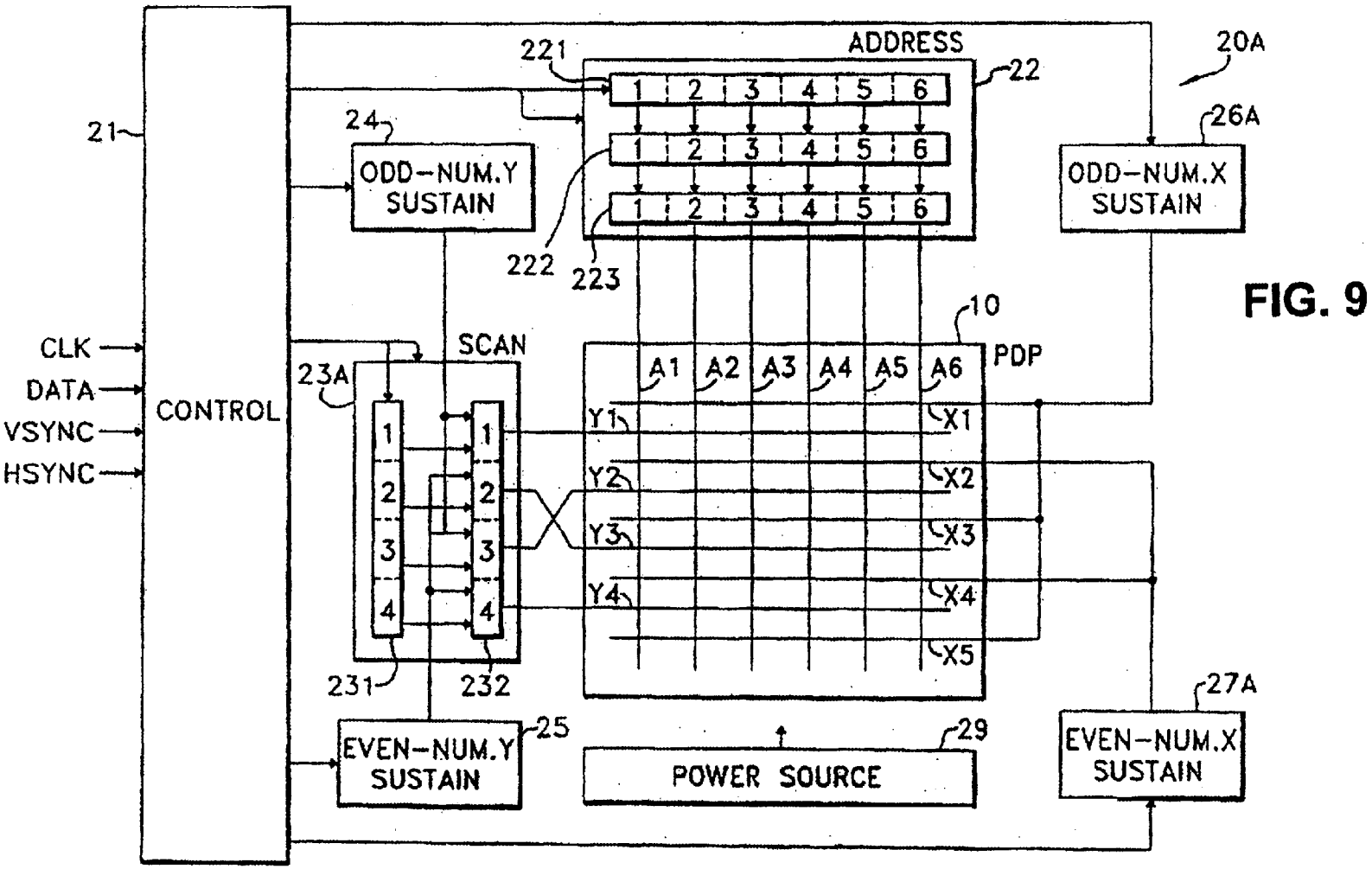
FIG. 9 is a block diagram showing a schematic structure of a plasma display apparatus in the second embodiment according to the present invention.

FIG. 9 shows the schematic structure of a plasma display apparatus 20A in the second embodiment for implementing this method.

Figure 10:
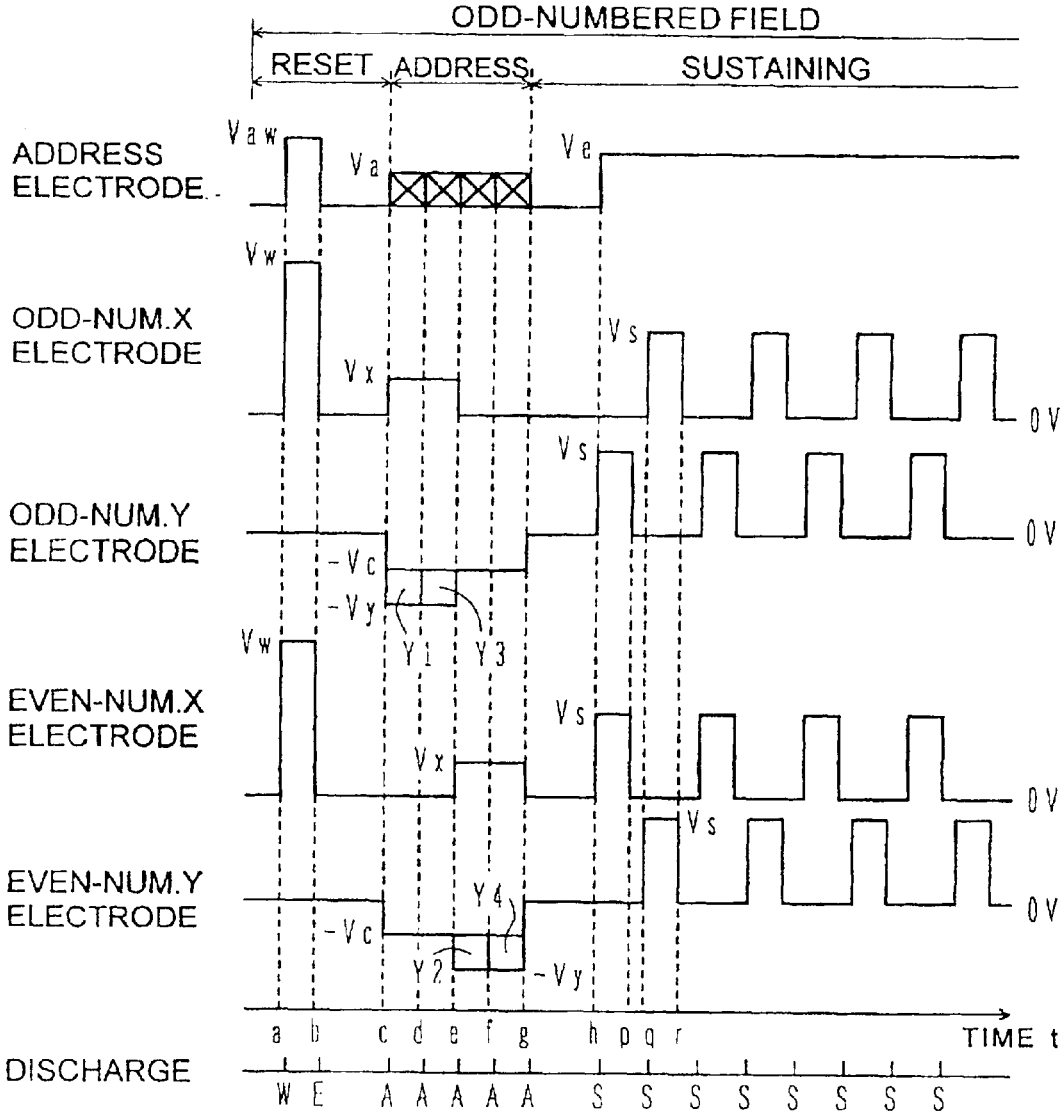
FIG. 10 is a waveform diagram of voltages applied to the electrodes in an odd-numbered field, for illustrating a method of driving the PDP in the second embodiment according to the present invention.
Figure 11:
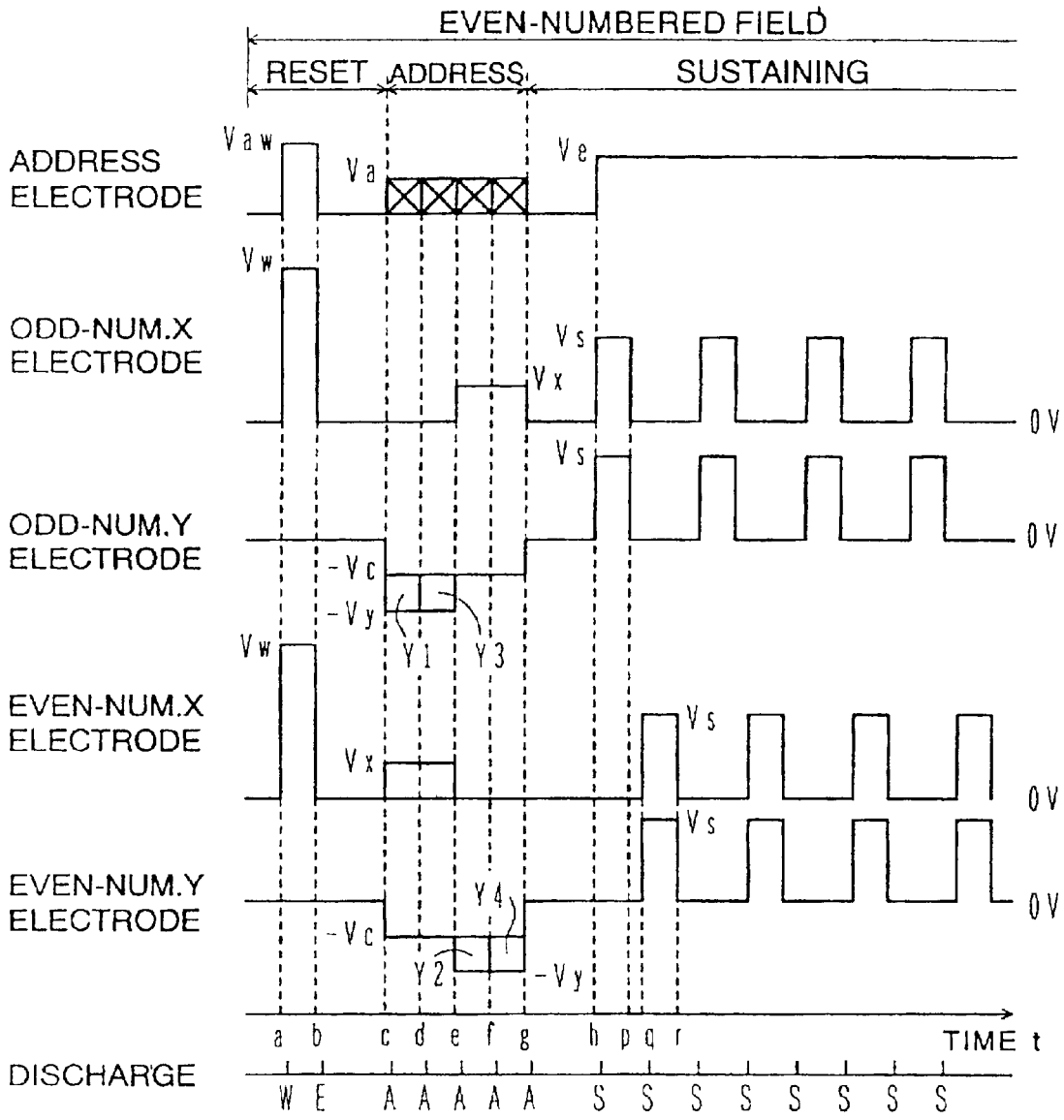
FIG. 11 is a waveform diagram of voltages applied to the electrodes in an even-numbered field, illustrating the method of driving the PDP in the second embodiment according to the present invention.

During an address period, in order to perform scanning in the order of the electrodes Y1, Y3, Y2 and Y4, the output of the driver 232(2) is connected to the electrode Y3 and the output of a driver 232(3) is connected to the electrode Y2. A scanning circuit 23A differs from the scanning circuit 23 shown in FIG. 4 in that the output of an odd-numbered Y sustain circuit 24 is connected to the inputs of the driver 232(1) and the driver 232(2) and the output of an even-numbered Y sustain circuit 25 is connected to the inputs of the driver 232(3) and the driver 232(4). In correspondence to this, an odd-numbered X sustain circuit 26A and an even-numbered X sustain circuit 27A output signals to ensure that the waveforms of the voltages applied to the odd-numbered X electrodes and the even-numbered X electrodes are as shown in FIGS. 10 and 11.

Each of the odd-numbered X electrodes and the even-numbered X electrodes require only one pulse with a large width to be supplied during each address period of the odd-numbered field or the even-numbered field, resulting in a reduction in power consumption compared to the structure shown in FIG. 4. In addition, the structures of the odd-numbered X sustain circuit 26A and the even-numbered X sustain circuit 27A are simplified compared to those of the odd-numbered X sustain circuit 26 and the even-numbered X sustain circuit 27 shown in FIG. 4.

Other features of the second embodiment are identical to those in the first embodiment.

Third Embodiment

In FIG. 7, the common pulse at the voltage Vx is supplied to the electrodes X1, X3 and X5 and the common pulse at the voltage Vx is supplied to the electrodes X2 and X4. However, it suffices to supply a pulse at the voltage Vx to the electrodes X1 to X4 selected sequentially when the electrodes Y1 to Y4 are selected sequentially. In this way, the number of pulses supplied to the electrodes is reduced and power consumption is also reduced.

Figure 12:
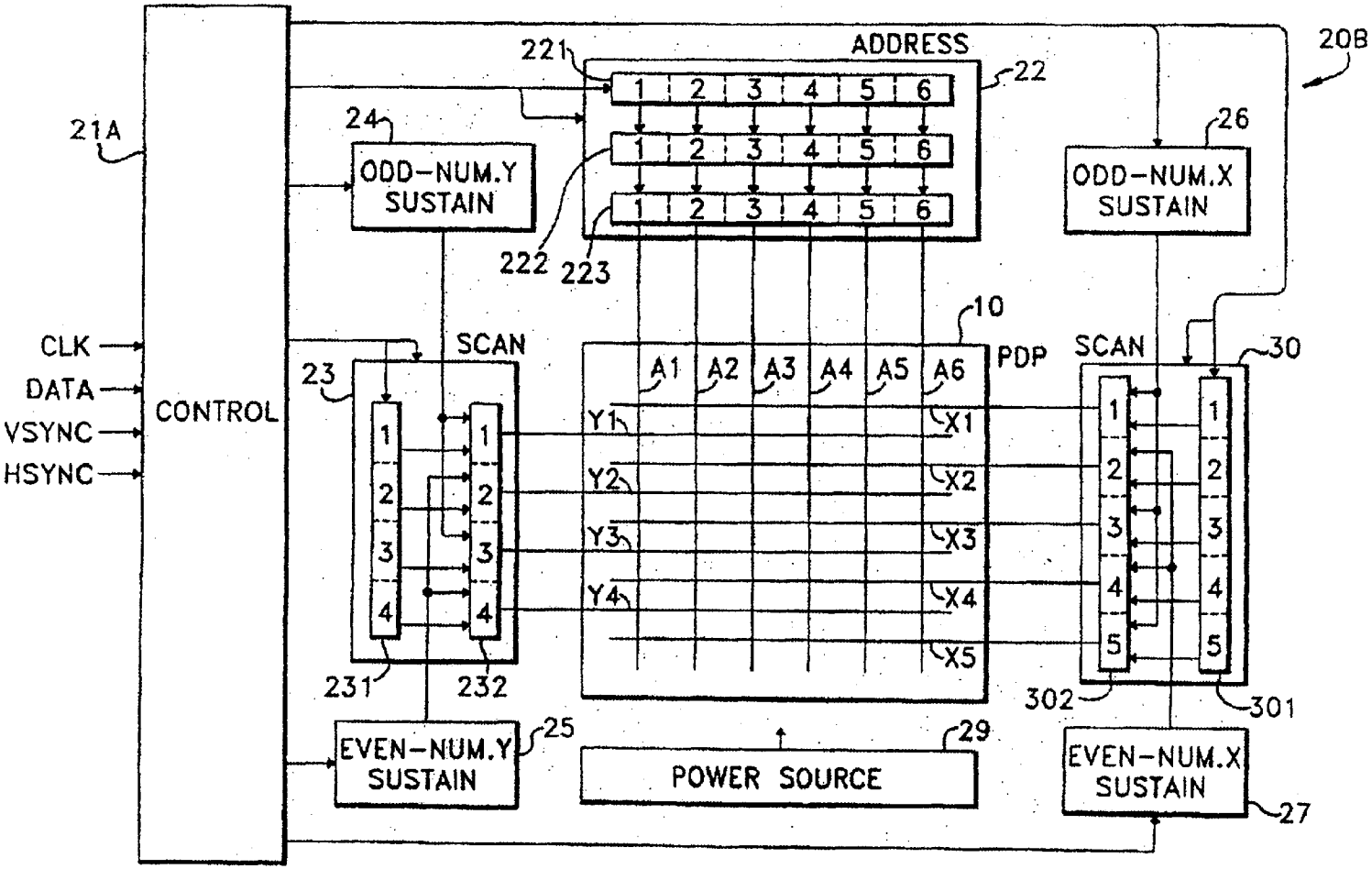
FIG. 12 is a block diagram showing a schematic structure of a plasma display apparatus in the third embodiment according to the present invention.

To achieve the above in a plasma display apparatus 20B in the third embodiment, a scanning circuit 30 is provided for the X electrodes, too, as shown in FIG. 12. The scanning circuit 30 is different from the scanning circuit 23 only in that the number of components is larger by the equivalent of one electrode.

During an address period, "1" is provided to the data input for bit 301(1) in the odd-numbered field and "1" is provided to the data input for bit 301(2) in the even-numbered field at a shift register 301 from a control circuit 21A. During a reset period and a sustain period, the output from the shift register 301 is set to 0.

Other features of the third embodiment are identical to those in the first embodiment.

In the third embodiment according to the present invention, during an address period, only necessary pulses are supplied to the X electrodes, reducing the power consumption compared to the first embodiment.

Fourth Embodiment

Since some of the drive voltage waveforms shown in FIGS. 7 and 8 are identical, if a control signal for obtaining identical drive voltage waveforms can be output from a common circuit, the circuit structure is simplified.

Figure 13:
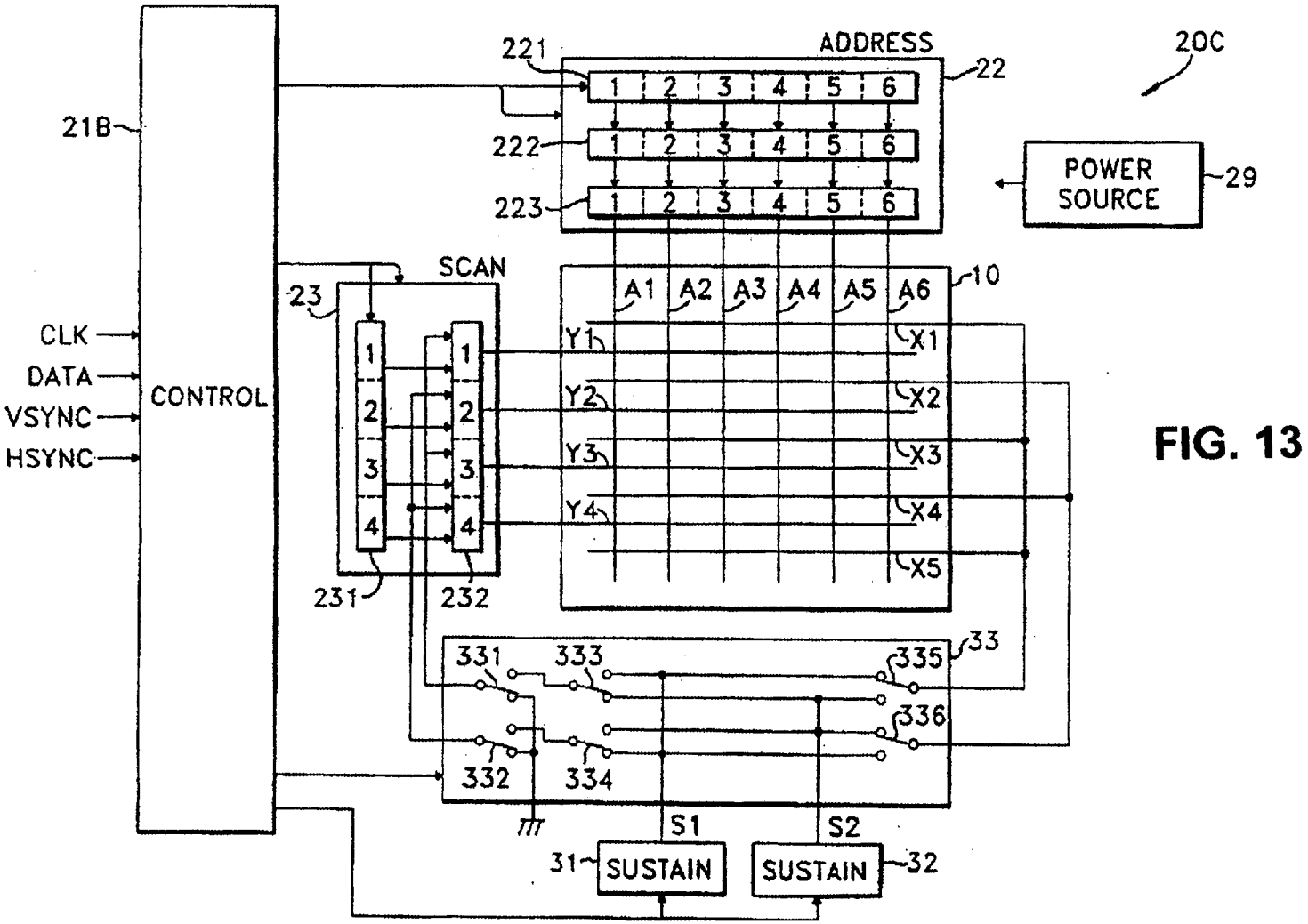
FIG. 13 is a block diagram showing a schematic structure of a plasma display apparatus in the fourth embodiment according to the present invention.
Figure 14:
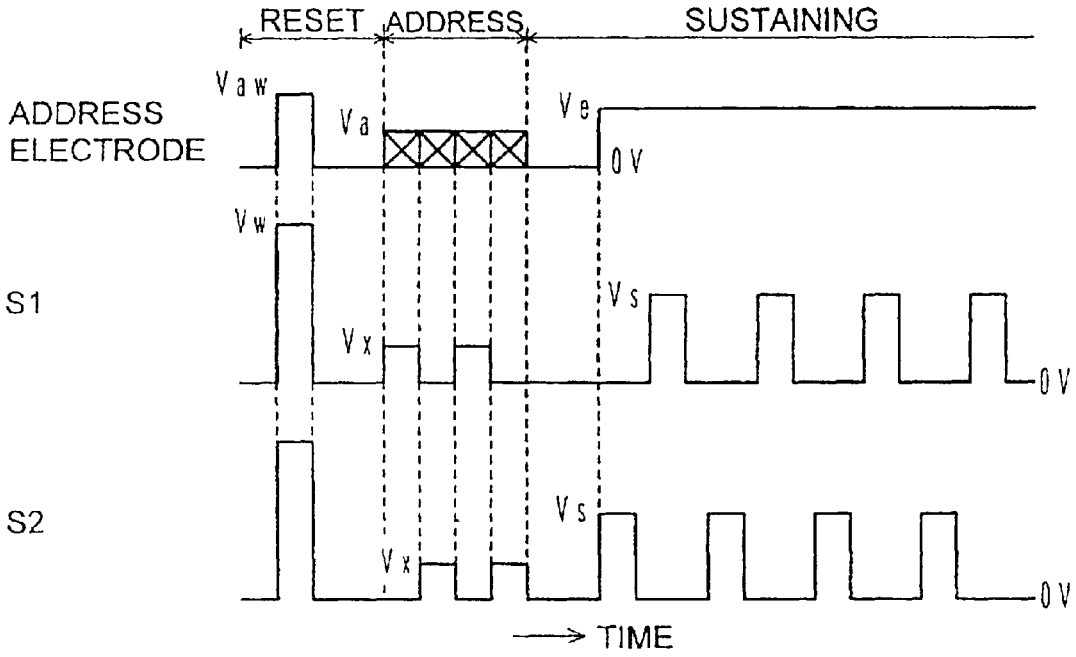
FIG. 14 shows waveforms of output voltages from the sustain circuits 31 and 32 in FIG. 13 along with waveforms of voltage applied to the address electrodes in the odd-numbered fields in FIG. 7.

To achieve this, in the fourth embodiment according to the present invention, a plasma display apparatus 20C is structured as shown in FIG. 13. In this unit, the odd-numbered Y sustain circuit 24, the even-numbered Y sustain circuit 25, the odd-numbered X sustain circuit 26 and the even-numbered X sustain circuit 27 in FIG. 4 are replaced by sustain circuits 31 and 32 and a switching circuit 33. As shown in FIG. 14, the waveforms S1 and S2 of the output voltages from the sustain circuits 31 and 32 are identical to the waveforms of the voltages applied to the odd-numbered X electrodes and the even-numbered X electrodes shown in FIG. 7. In FIG. 13, the switching circuit 33 is provided with changeover switching elements 331 and 332 which interlock with each other, changeover switching elements 333 and 334 that interlock with each other and changeover switching elements 335 and 336 which interlock with each other. These changeover switching elements may be constituted with FETs, for instance. The switching control for the switching circuit 33 is executed by a control circuit 21B.

In the state shown in FIG. 13, 0V is supplied to the inputs of drivers 232(1) to 232(4) and the voltage waveforms S1 and S2 are supplied to the odd-numbered X electrodes and the even-numbered X electrodes respectively. This corresponds to the reset period and the address period in FIG. 7. In the address period, the scanning circuit 23A decides the voltage waveforms supplied to the Y electrodes. If the switching elements 335 and 336 are switched over, this corresponds to the reset period and the address period in FIG. 8.

Next the changeover switching elements 331 and 332 are switched over from the state shown in FIG. 13, the voltage waveforms S2 and S1 are supplied to the inputs of the odd-numbered elements of the driver 232 and the even-numbered elements of the driver 232 respectively and this corresponds to the sustain period shown in FIG. 7.

When the changeover switching elements 335 and 336 are switched over in this state, the voltage waveforms S2 and S1 are supplied to the odd-numbered X electrodes and the even-numbered X electrodes and this corresponds to the sustain period shown in FIG. 8.

With the plasma display apparatus 20C in the fourth embodiment, the same operation as that performed by the unit shown in FIG. 4 can be performed in a simpler structure compared to the unit shown in FIG. 4.

Fifth Embodiment

Figure 15:
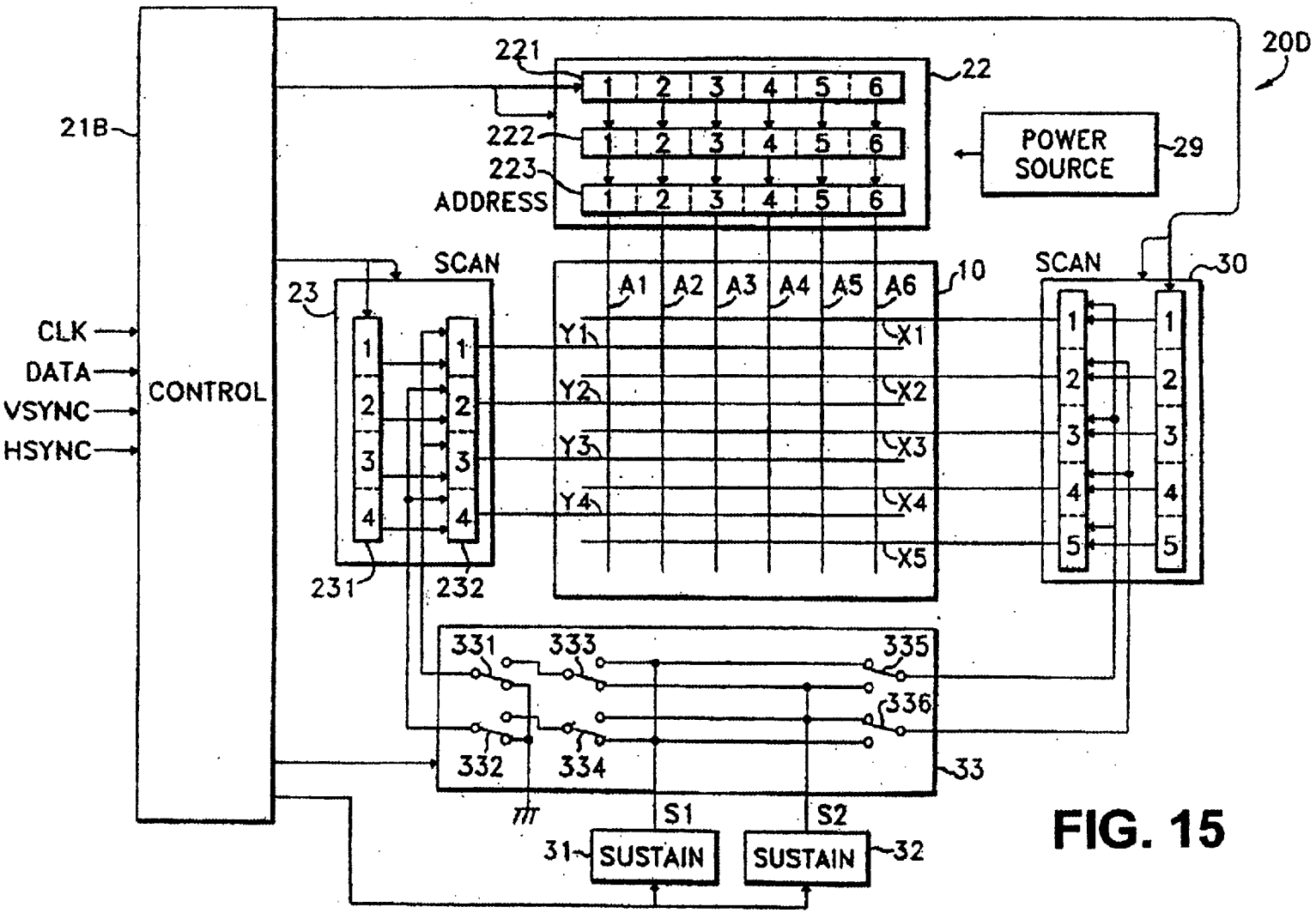
FIG. 15 is a block diagram showing a schematic structure of a plasma display apparatus in the fifth embodiment according to the present invention.

The features of the unit shown in FIG. 13 can be adopted in the plasma display apparatus shown in FIG. 12. FIG. 15 shows a plasma display apparatus 20D in which these features are adopted as a fifth embodiment according to the present invention.

The sustain circuits 31 and 32 and the switching circuit 33 perform operation identical to that performed in FIG. 13, based upon control signals from a control circuit 21C.

In the plasma display apparatus 20D in the fifth embodiment, operation identical to that performed by the unit shown in FIG. 12 can be performed in a simpler structure compared to the unit in FIG. 12.

Sixth Embodiment

In the embodiments described so far, even though the even-numbered field is not displayed for each subfield in the odd-numbered field shown in FIG. 5, a whole-screen write discharge W and a whole-screen self-erasing discharge E are performed during the reset period. This could cause the quality of black display to become reduced due to unwanted light emission. The same applies to the even-numbered field, as well. In the sixth embodiment, in order to reduce this unwanted light emission, voltages with the waveforms shown in FIGS. 16 and 17 are supplied to the electrodes.

Figure 16:
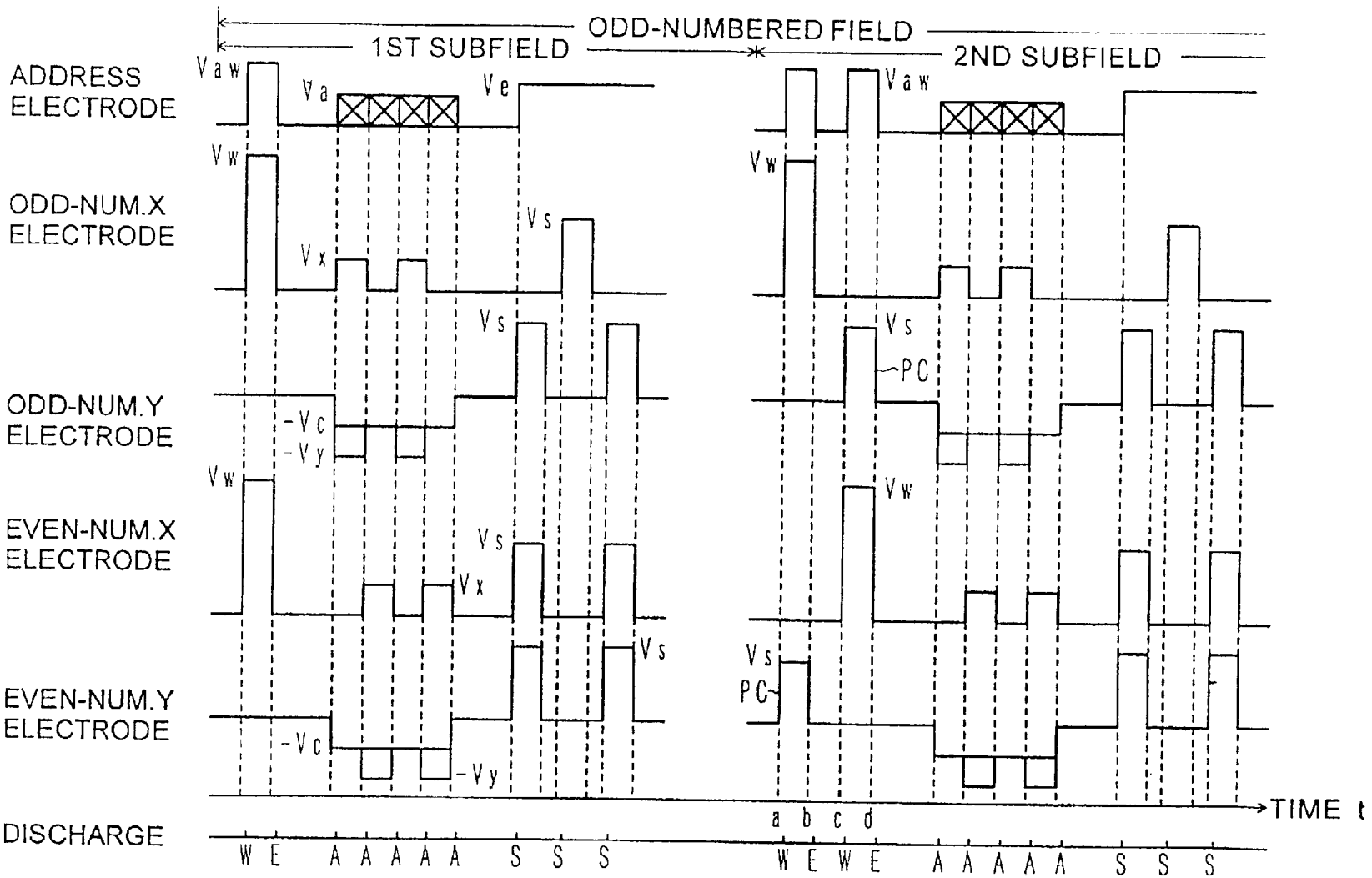
FIG. 16 is a waveform diagram of voltages applied to the electrodes in an odd-numbered field, for illustrating a method of driving the PDP in the sixth embodiment according to the present invention.
Figure 17:
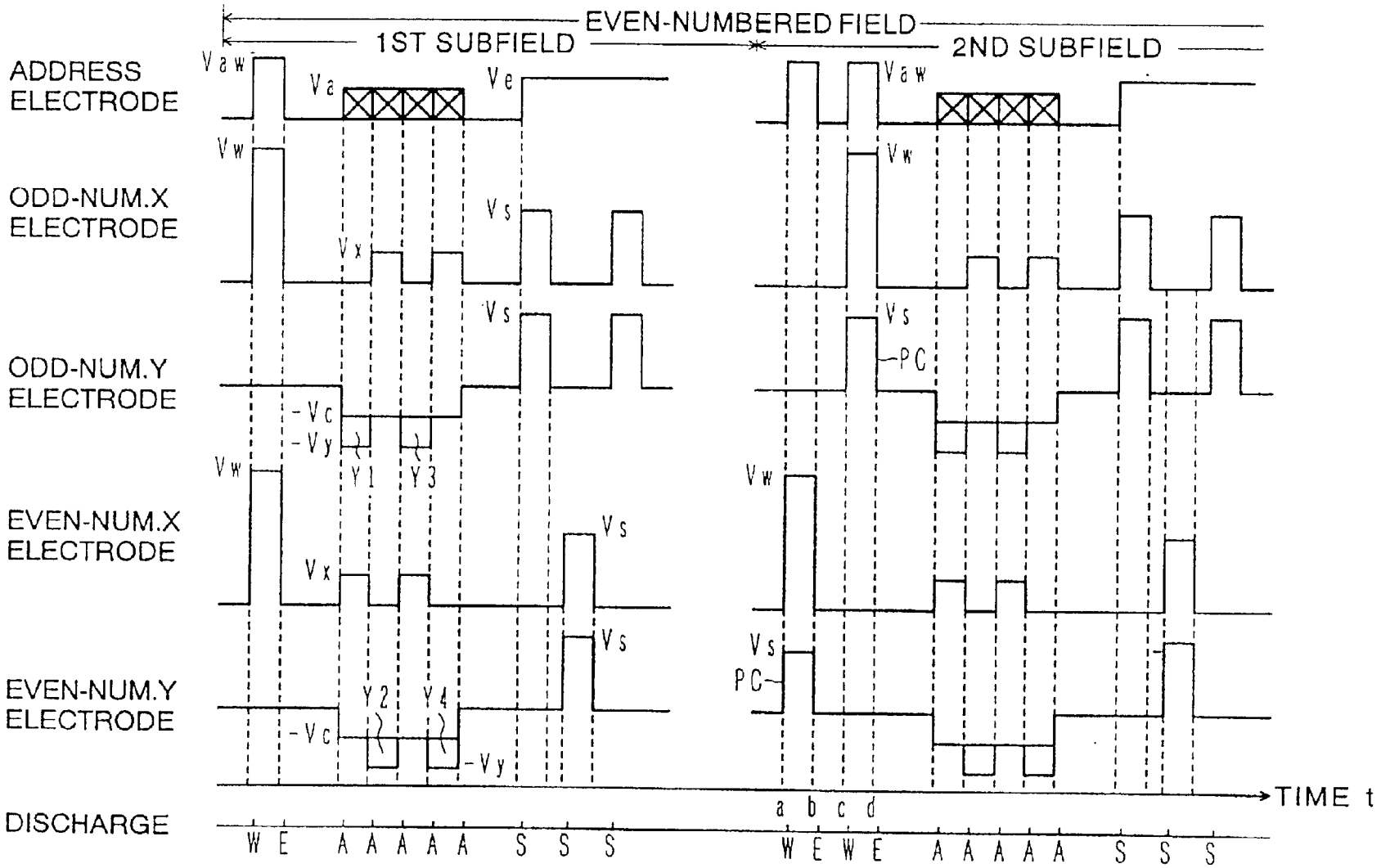
FIG. 17 is a waveform diagram of voltages applied to the electrodes in an even-numbered field, for illustrating the method of driving the PDP in the sixth embodiment according to the present invention.

The first subfield in FIG. 16 is the same as that in. FIG. 7 and during a reset period, light emission due to the whole-screen write discharge W and the whole-screen self-erasing discharge E occurs for the undisplayed lines, too. This is necessitated because the wall charge performed in the preceding even-numbered field must be eliminated. However, since no discharge occurs in undisplayed lines during an address period and a sustain period, it is not necessary to cause a write discharge W and a self-erasing discharge E in the undisplayed lines during the reset period in the second and subsequent subfields of an odd-numbered field.

Accordingly, during a reset period in the second and subsequent subfield of an odd-numbered field, by supplying a cancel pulse PC at the voltage Vs to the even-numbered Y electrodes adjacent to the odd-numbered X electrodes, the voltage between the odd-numbered X electrode and the even-numbered Y electrode is kept below Vfxy−Vwall to prevent discharge. At this juncture, if a write pulse at the voltage Vw is supplied to the even-numbered X electrodes, discharge will not occur between the even-numbered X electrode and the even-numbered Y electrode which constitute the display line either. Therefore, the application time of this write pulse is shifted from $a \leqq t \leqq b$ to $c \leqq t \leqq d$. With this, discharge occurs between the odd-numbered Y electrode and the even-numbered X electrode which constitute the undisplayed line. Therefore, a cancel pulse PC at the voltage Vs is further supplied to the odd-numbered Y electrodes. Since this cancel pulse PC is offset from the write pulse supplied to the odd-numbered X electrodes on the time axis, it does not affect the write discharge occurring between the odd-numbered X electrode and the odd-numbered Y electrode.

While t=a to b and t=c to d, a pulse at the voltage Vaw is supplied to the address electrodes in correspondence to the write voltage supplied to odd-numbered X electrodes and the even-numbered X electrodes. The subsequent operation from t=d is identical to that performed when the cancel pulse PC is not supplied as described. The reset period in the third or subsequent subfields of the odd-numbered field is also the same as the reset period of the second subfield.

The situation for the even-numbered field is identical to that for the odd-numbered field and is shown in FIG. 17. In the case of the even-numbered field, for the same reason as that explained in the first embodiment earlier, the waveforms of the voltages supplied to the odd-numbered X electrodes and the even-numbered X electrodes in FIG. 16 only have to be switched to the reverse of each other.

Seventh Embodiment

Figure 18:
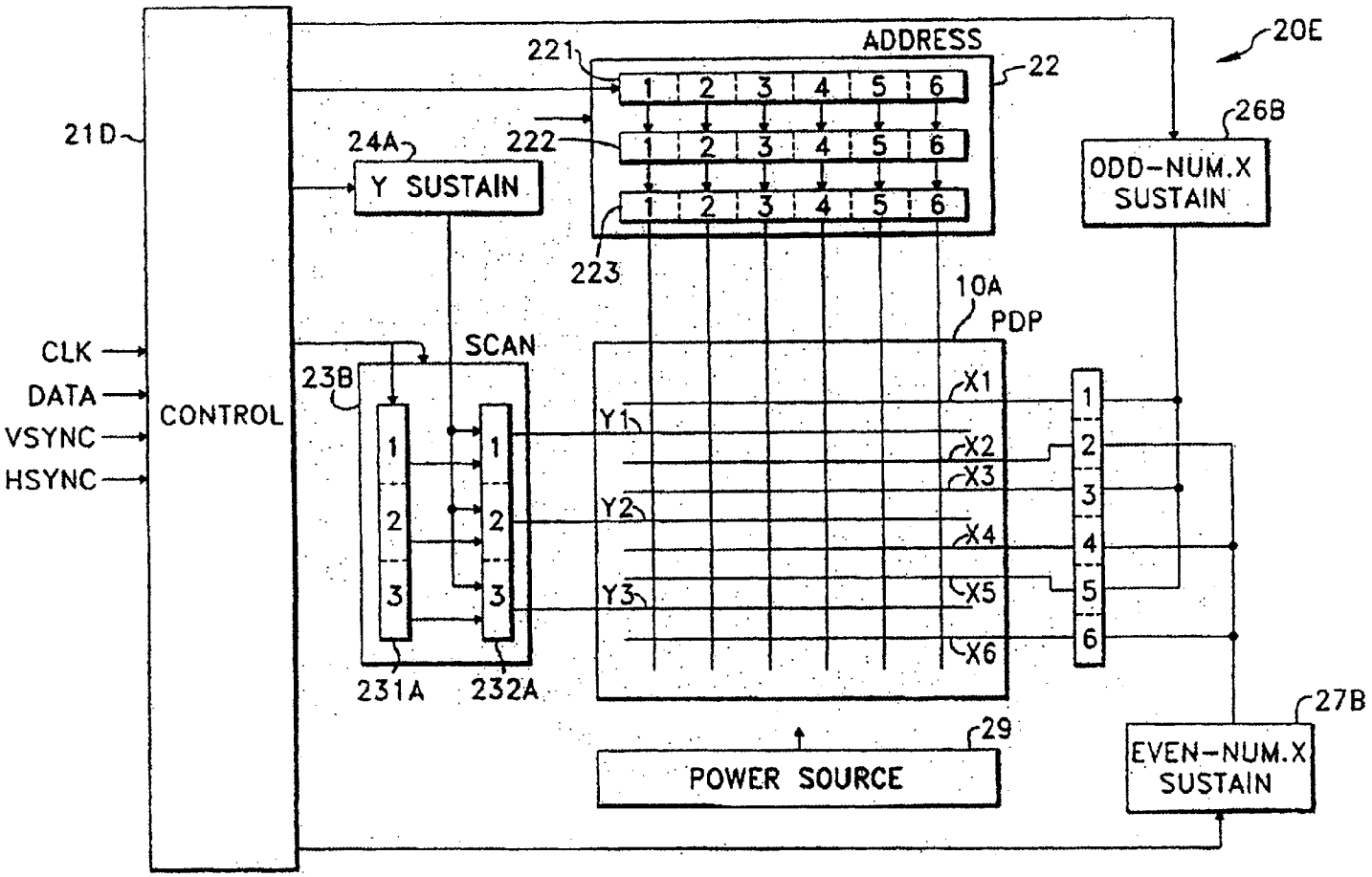
FIG. 18 is a block diagram showing a schematic structure of a plasma display apparatus in the seventh embodiment according to the present invention.

FIG. 18 shows a plasma display apparatus 20E in the seventh embodiment according to the present invention.

The schematic structure of the PDP 10A is identical to that of the PDP 10 shown in FIG. 1. However, the electrodes are used differently from that shown in FIG. 4. Namely, the electrodes Y1, Y2 and Y3 are not divided into odd-numbered and even-numbered groups but the electrodes X1, X3 and X5 which are adjacent to the electrodes Y1 to Y3 on one side are designated the odd-numbered X electrodes and the electrodes X2, X4 and X6 which are adjacent to the electrodes Y1 to Y3 on the other side are designated the even-numbered X electrodes. Interlaced display is executed for odd-numbered display lines constituted with pairs of electrodes (Y1, X1), (Y2, X3) and (Y3, X5) and even-numbered display lines constituted with pairs of electrodes (Y1, X2), (Y2, X4) and (Y3, X6)

Figure 30:
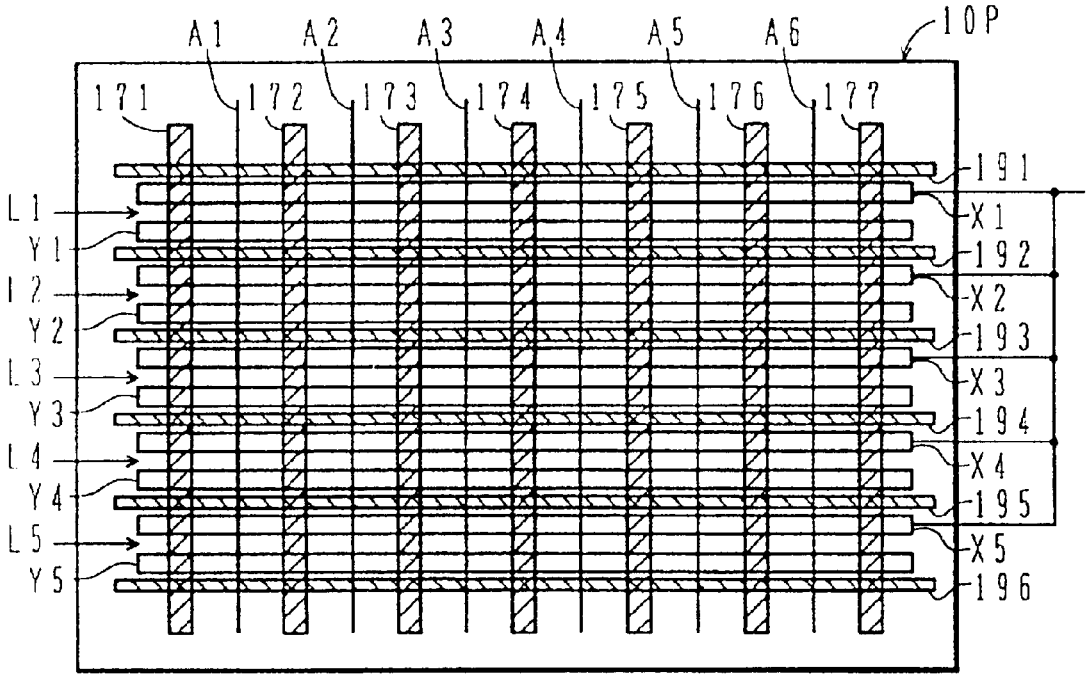
FIG.30 PRIOR ART
FIG. 30 shows a schematic structure of a surface discharge PDP in the prior art.

Although the lines between the even-numbered X electrode and the odd-numbered X electrode are completely undisplayed lines, since two display lines are formed with three parallel electrodes and partitioning walls parallel to the electrodes for surface discharge are not provided, the pixel pitch can be shortened compared to the structure, as shown in FIG. 30, in which two display lines are formed with four parallel electrodes and partitioning walls parallel to the electrodes for surface discharge are provided, making higher definition possible. In addition, since the electrodes Y1 to Y3 are not divided into an even-numbered group and an odd-numbered group, the structure is simplified compared to that in the first embodiment.

Figure 19:
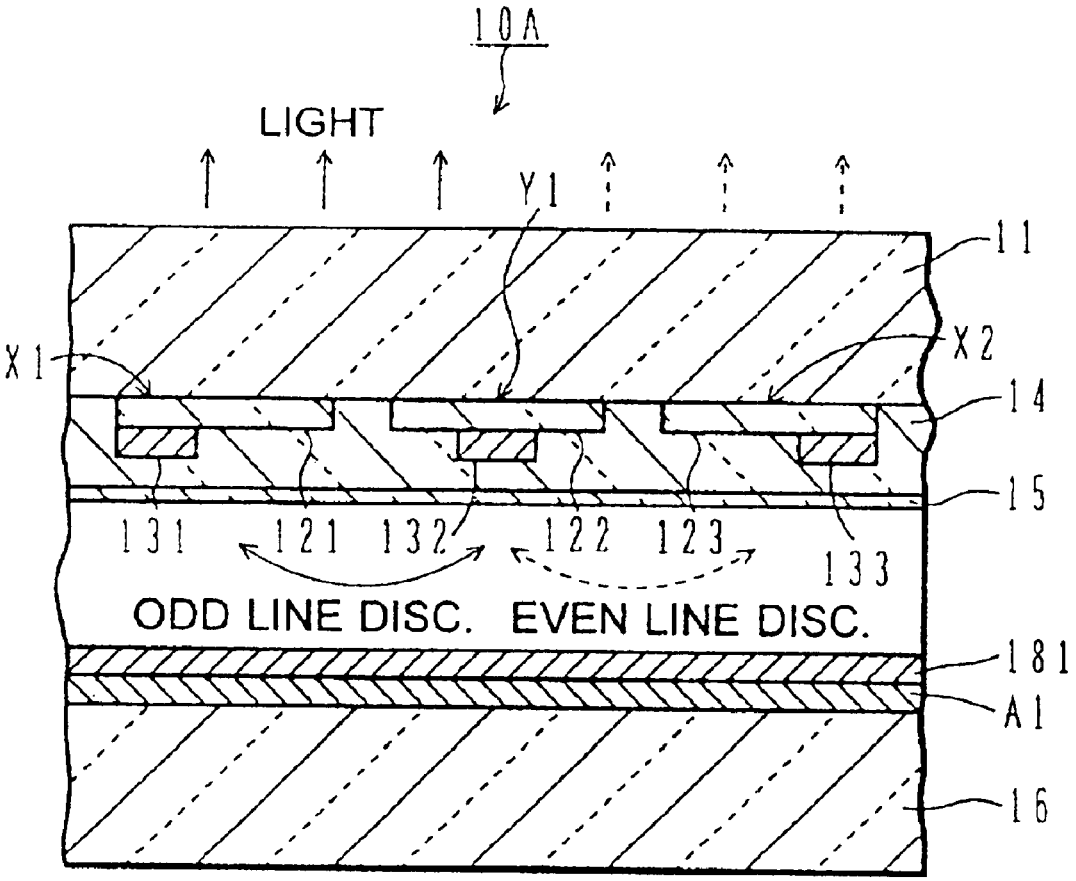
FIG. 19 is a longitudinal cross sectional view of a part of the PDP shown in FIG. 18, along the address electrodes.

FIG. 19 shows a longitudinal cross section of the PDP 10A shown in FIG. 18 along the address electrodes.

The difference of this structure from the structure shown in FIG. 2 is that for the electrodes X1 and X2 at the two sides of the electrode Y1, metal electrodes 131 and 133 are formed toward the side which is furthest away from the electrode Y1 on transparent electrodes 121 and 123 respectively. This structural feature is adopted at the two sides of each of the Y electrodes. This makes the electric field stronger on the metal electrode 131 side above the electrode X1 when a voltage is supplied between the X1–Y1 electrodes and, therefore, even if the electrode pitch is reduced in order to achieve higher definition, the pixel area can be increased essentially, compared to the structure in which the metal electrode 131 is formed along the central line on the transparent electrode 121. Since the lines on the opposite sides of the electrodes X1 and X2 relative to the electrode Y1 are undisplayed lines, this does not present any problems and, moreover, it is desirable because the undisplayed lines can be narrowed essentially. In FIG. 19, although the width of the transparent electrode 122 is made equal to the widths of the transparent electrodes 121 and 123, the width of the electrode Y1, which is supplied with the scanning pulse, may be narrow to reduce the power consumption.

In FIG. 18, a scanning circuit 23B, an odd-numbered sustain circuit 26B and an even-numbered sustain circuit 27B respectively correspond to the scanning circuit 23, the odd-numbered X sustain circuit 26 and the even-numbered X sustain circuit 27 shown in FIG. 4. Compared to the structure in FIG. 4, a single Y sustain circuit 24A can replace the odd-numbered Y sustain circuit 24 and the even-numbered Y sustain circuit 25, simplifying the structure.

Figure 20:
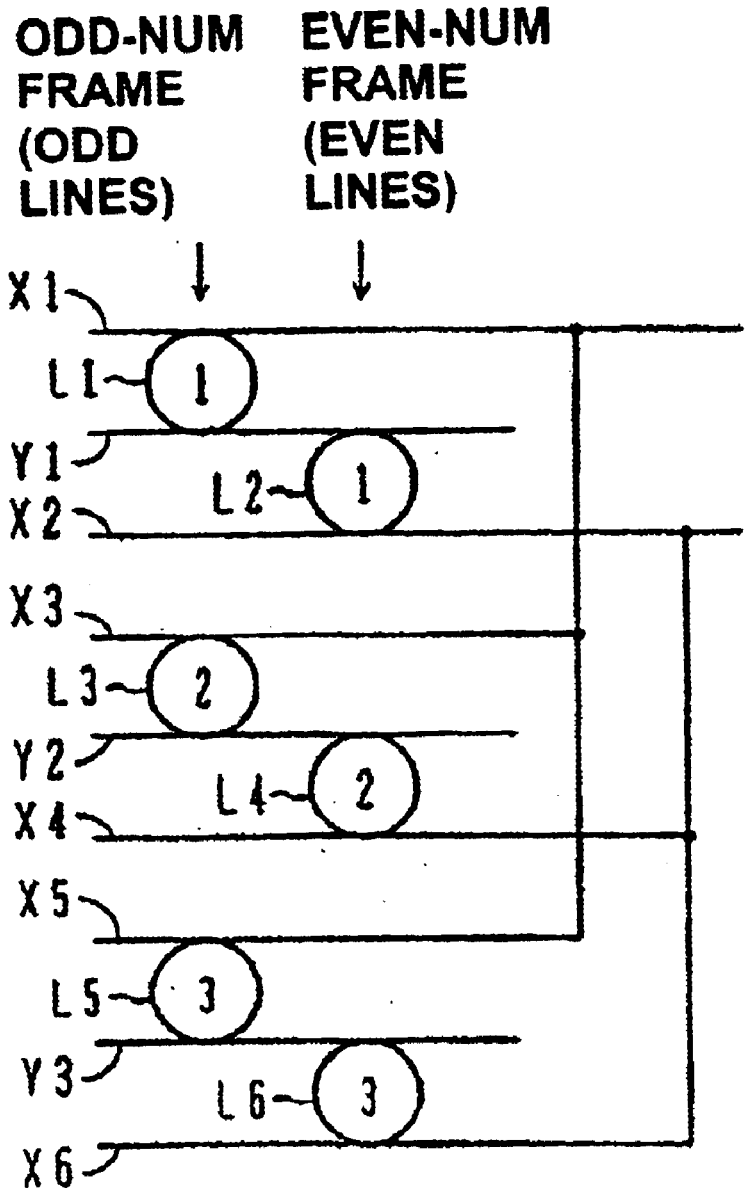
FIG. 20 shows the order in which the display lines are scanned during an address period.
Figure 21:
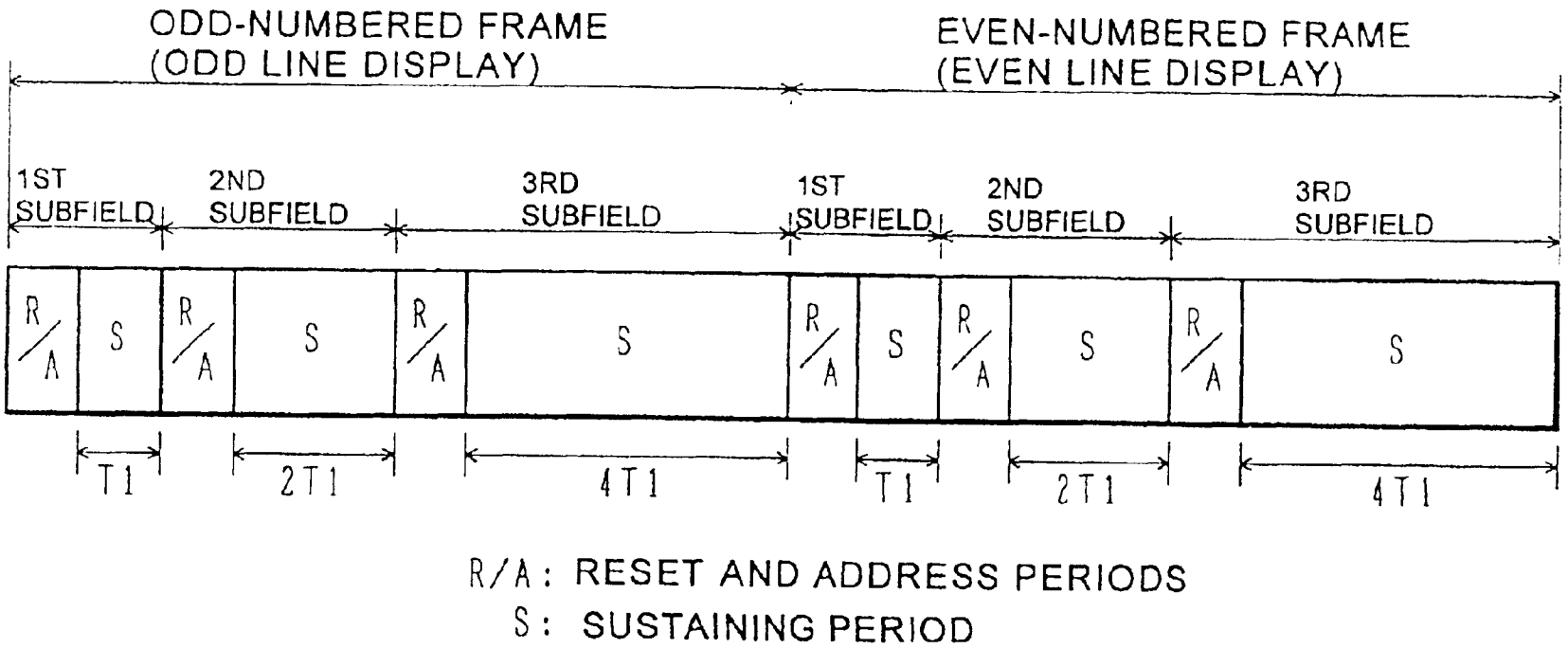
FIG. 21 shows a structure of a frame.

FIG. 20 shows the order in which the display lines are scanned during an address period. Since the lines between the even-numbered X electrode and the odd-numbered X electrode is completely undisplayed line, if one frame is to be divided into an odd-numbered field and an even-numbered field as shown in FIG. 6(A), the display lines will be thinned out at the ratio of one to three in each field, which is not desirable from the viewpoint of maintaining display quality. This problem is solved by scanning the display lines L1, L3 and L5 sequentially with only writing the display data of the odd-numbered field at the odd-numbered frame, and by scanning the display lines L2, L4 and L6 sequentially with only writing the display data of the even-numbered field at the even-numbered frame. In that case, the structure of the frame corresponding to that in FIG. 5 is as shown in FIG. 21.

Figure 22:
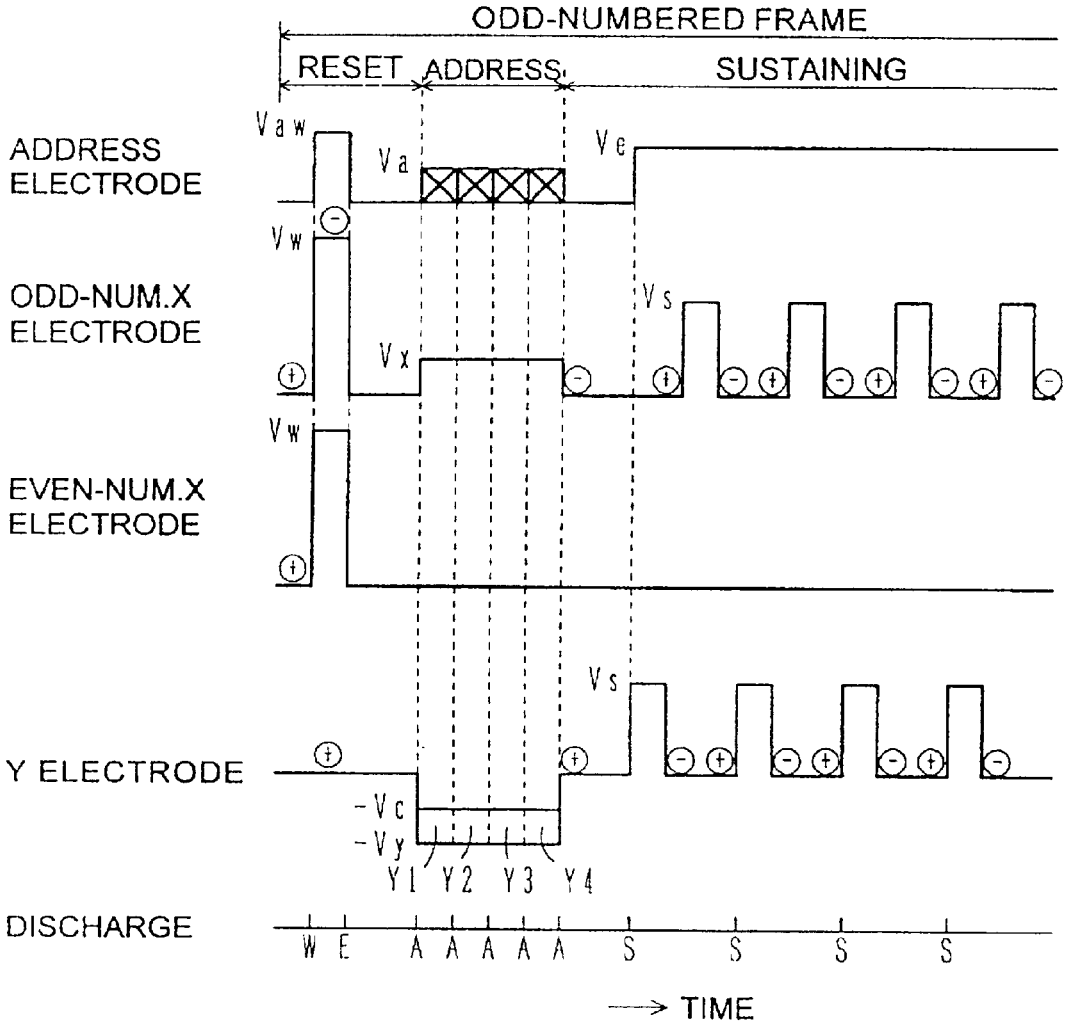
FIG. 22 is a waveform diagram of voltages applied to the electrodes in an odd-numbered frame, for illustrating the method of driving the PDP in the seventh embodiment according to the present invention.

FIG. 22 shows the waveforms of the voltages applied to the electrodes in the odd-numbered frame in case that a number of Y electrodes is four.

During a reset period, a whole-screen write discharge W and a whole-screen self-erasing discharge E occur in the display lines L1 to L6 in FIG. 20. However, since the voltage between the even-numbered X electrode and the odd-numbered X electrodes is at 0, no discharge occurs in the completely undisplayed lines. This is the difference from the case illustrated in FIG. 7.

During an address period, Since the electrodes Y1 to Y4 are sequentially scanned, one pulse with a large width is supplied to the odd-numbered X electrodes, making it possible to reduce the power consumption compared to the case in FIG. 7.

During a sustain period, a sustain pulse at the voltage Vs is cyclically supplied to the Y electrodes, a pulse train obtained by shifting the phase of the pulse train to the Y electrodes by 180° is supplied to the odd-numbered X electrodes. Therefor, an AC sustain pulse is supplied between the odd-numbered X electrode and the Y electrode and sustaining discharge occurs in the same manner as that in the first embodiment. Since the even-numbered X electrodes are set at 0V, AC voltage is not supplied to the undisplayed lines between the even-numbered X electrode and the Y electrode and the even-numbered X electrode and the odd-numbered X electrode and, therefore, discharge does not occur among these electrodes.

Figure 23:
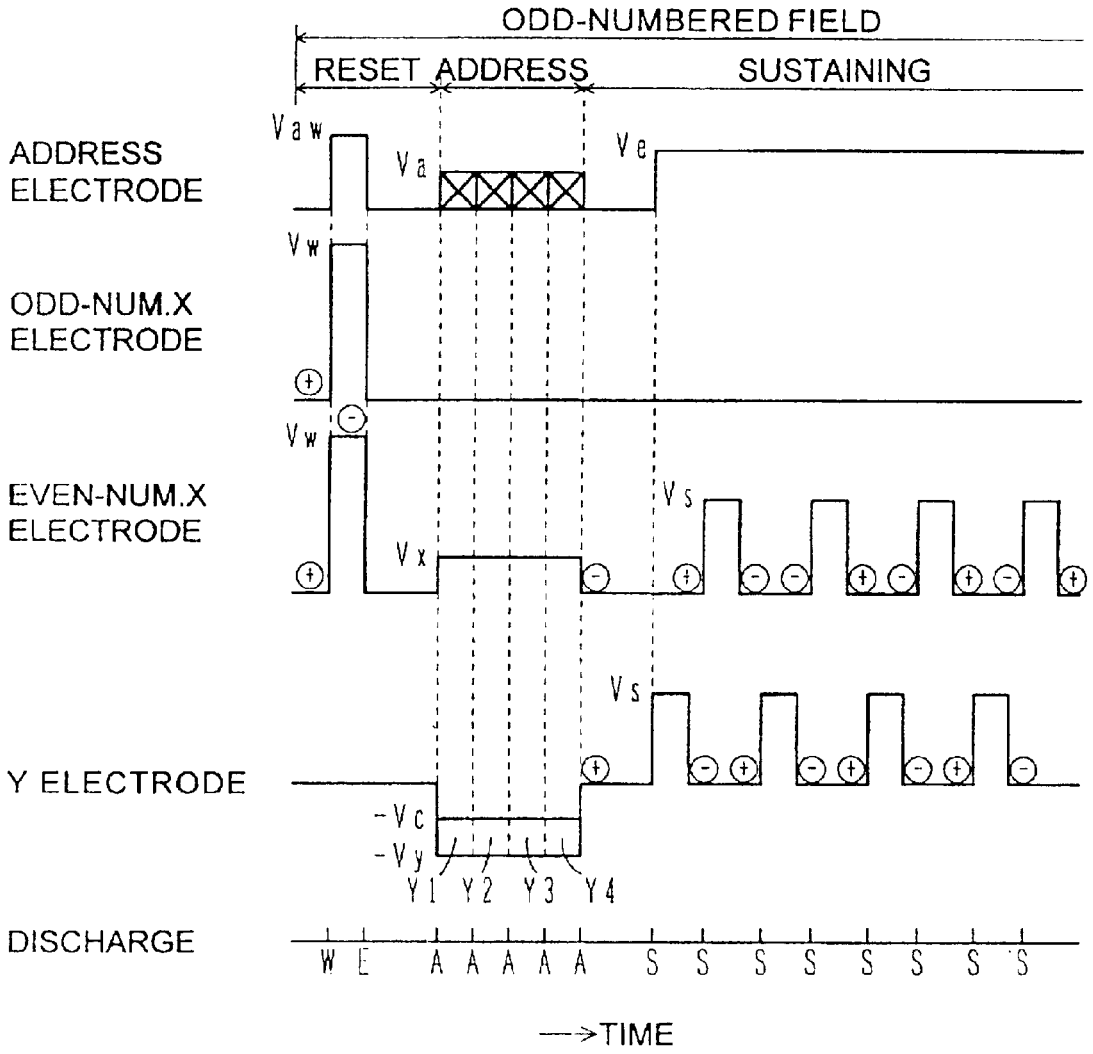
FIG. 23 is a waveform diagram of voltages applied to the electrodes in an even-numbered frame, for illustrating the method of driving the PDP in the seventh embodiment according to the present invention.

FIG. 23 shows the waveforms of the voltages supplied to the electrodes in the even-numbered frame. These waveforms are obtained by reversing the waveforms of the voltages supplied to the odd-numbered X electrodes and the even-numbered X electrodes to each other in FIG. 22.

In the seventh embodiment, since, by performing interlaced scan which displays odd-numbered frame and even-numbered frame mutually, the address period is reduced by half compared to that with non interlaced scanning, the sustaining discharge period is lengthened. With this, it becomes possible to achieve a higher number of gradations by increasing the number of sub frames or it becomes possible to achieve higher brightness by increasing the number of times the sustaining discharge is performed.

Eighth Embodiment

Figure 24:
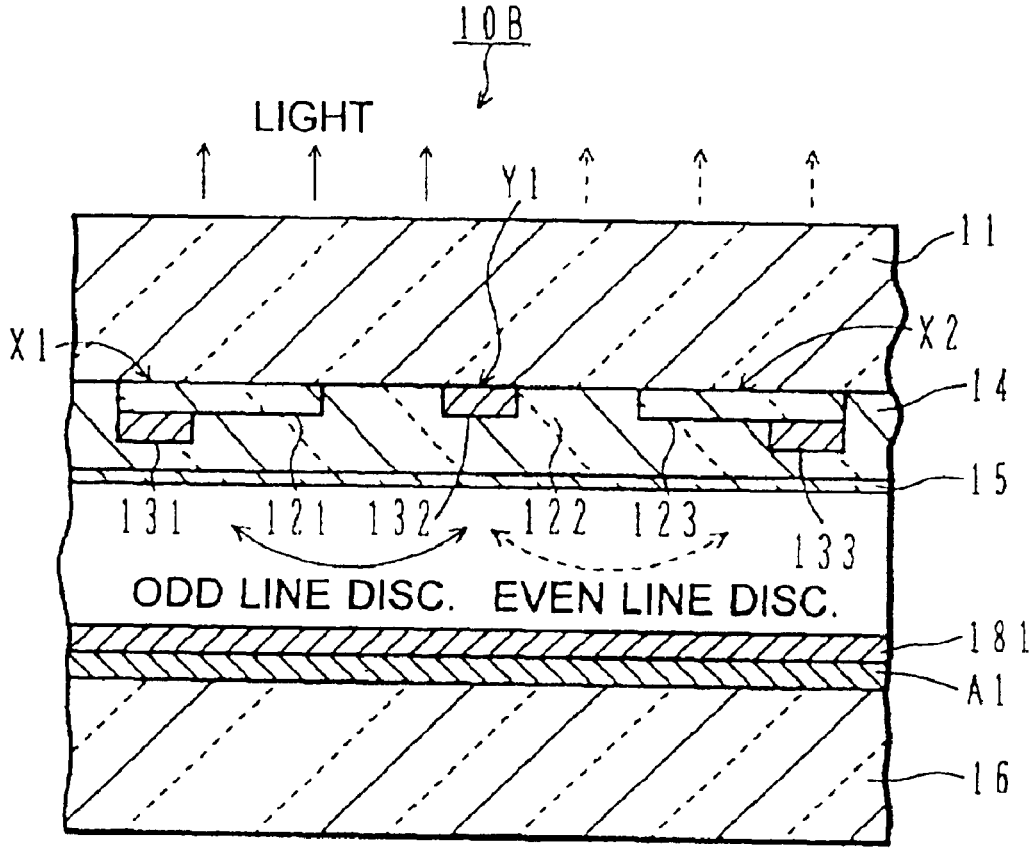
FIG. 24 is a longitudinal cross sectional view of a part of a PDP in the eighth embodiment along an address electrodes.

FIG. 24 shows the longitudinal cross section of part of the PDP 10B in the eighth embodiment according to the present invention, along the address electrodes.

The difference from the structure shown in FIG. 19 is that the transparent electrode 122 is omitted by constituting the electrode Y1 only with the metal electrode 132. This also applies to all the other Y electrodes. With this, as described earlier, the power consumption is reduced when scanning pulses are supplied to the Y electrodes. Moreover, it is possible to further reduce the pixel pitch.

Ninth Embodiment

Figure 25:
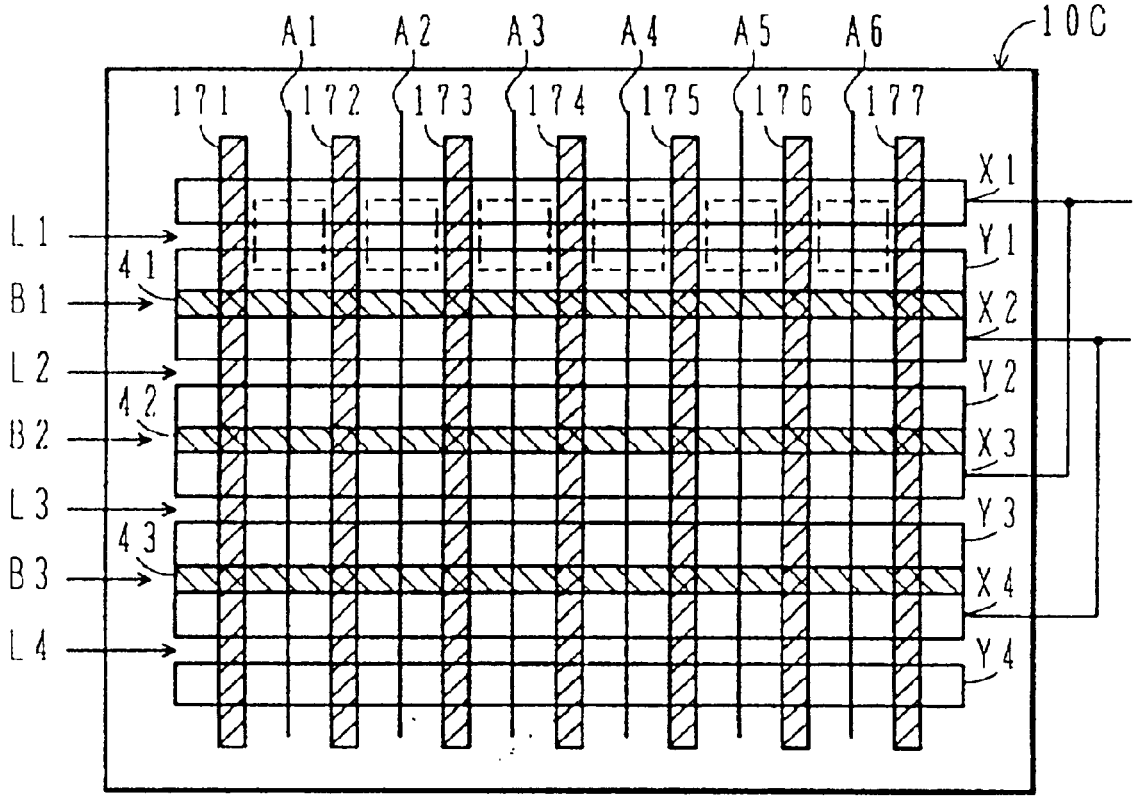
FIG. 25 shows a schematic structure of a surface discharge PDP in the ninth embodiment according to the present invention.

The discharge performed for eliminating the wall charge during a reset period, with its priming effect, makes address discharge occur more easily, making it possible to reduce the address discharge voltage. However, since the discharge light emission occurs over the entire surface, the quality of black display areas becomes reduced. Thus, in the ninth embodiment, a PDP 10C, as shown in FIG. 25, is employed to reduce the unwanted light emission.

In the PDP 10C, alternate lines between electrodes in the PDP 10 in FIG. 1 are blind lines B1 to B3. Since the blind lines B1 to B3 are completely undisplayed lines, non interlaced scanning is performed for the display lines L1 to L4.

Blind films (light-blocking masks) 41 to 43 are formed, for instance, at the portion between the transparent electrodes 121 and the transparent electrode 122 in FIG. 2 or on the surface of the glass substrate 11 which corresponds to this portion to ensure that the unwanted light emission at the blind lines B1 to B3 will not leak toward the viewer.

Figure 26:
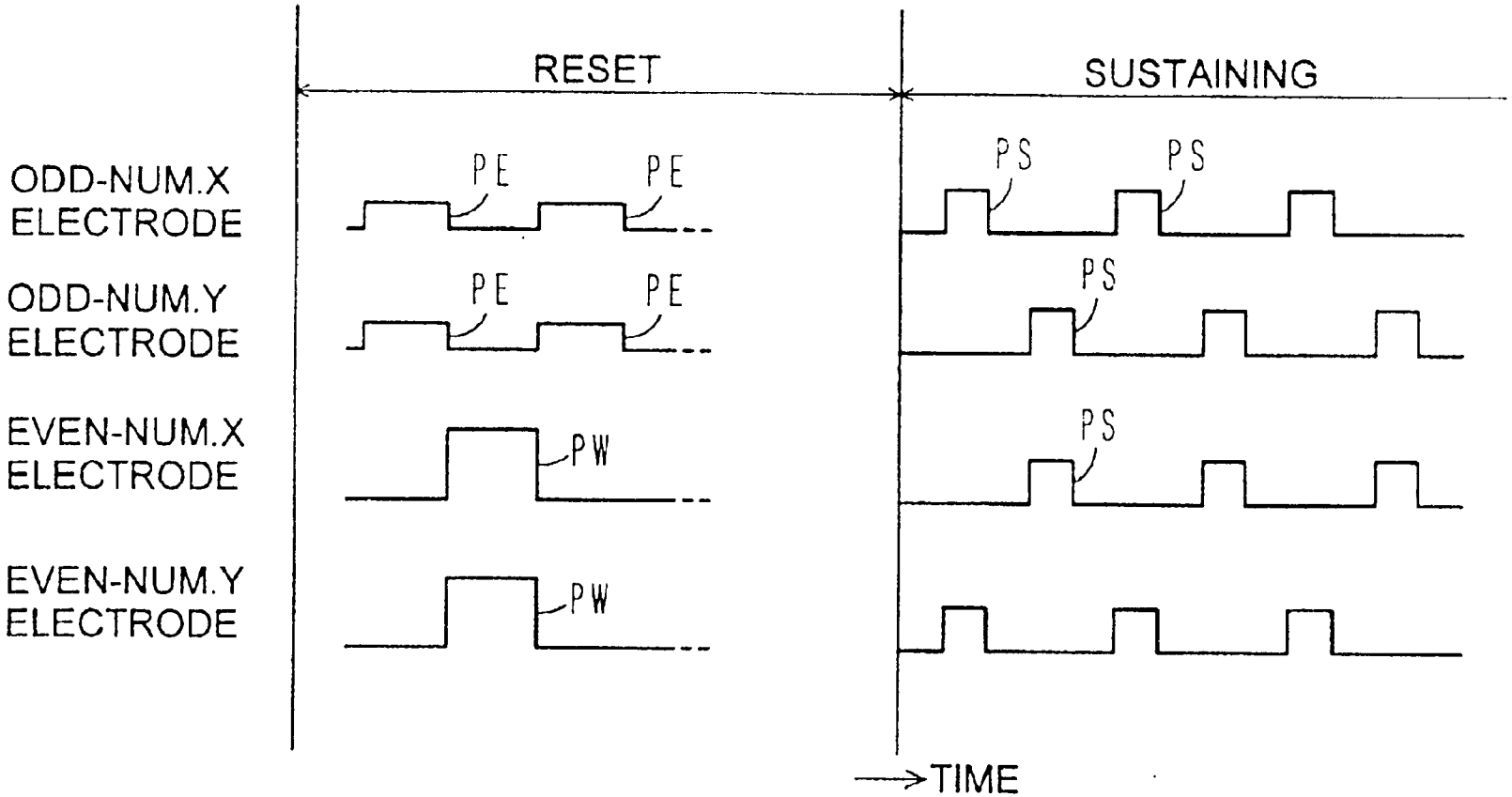
FIG. 26 is a schematic waveform diagram of voltages applied to the electrodes, illustrating a method of driving the PDP in the ninth embodiment according to the present invention.

FIG. 26 shows the waveforms of the voltages applied to the electrodes during a reset period and during a sustain period, and an address period is omitted. In the figure, PE indicates an erasing pulse, PW indicates a write pulse and PS indicates a sustaining pulse.

During a reset period, first, an erasing pulse PE whose voltage is lower than that of the sustaining pulse is supplied to the odd-numbered X electrodes and the odd-numbered Y electrodes, to perform erasing discharge for the wall charge at all the blind lines B1 to B3. Then, write pulse PW whose voltage is higher than that of the sustaining pulse is supplied to the even-numbered X electrodes and the even-numbered Y electrodes, to perform write discharge at all the blind lines B1 to B3, and the wall charge becomes almost constant at all the blind lines B1 to B3. The voltage of the write pulse PW is equal to or higher than the discharge start voltage but is lower than the voltage Vw in FIG. 7, and a self-erasing discharge does not occur after the fall of the write pulse PW. Therefore, the erasing pulse PE is supplied to the odd-numbered X electrodes and the odd-numbered Y electrodes again, to perform erasing discharge for the wall charge at all the blind lines B1 to B3. With such a discharge performed during a reset period, any floating space charge that has not been reunited flows into the display lines L1 to L4, making the address discharge occur more easily during an address period. During a reset period, since the voltages between the X–Y electrodes at all the display lines L1 to L4 are at 0V, discharge is not performed and the quality of black display areas is prevented from becoming degraded due to the generation of unwanted light emission.

The waveforms of the voltages applied to the electrodes during the address period are identical to those in the prior art for the display lines L1 to L4 or identical to those when the odd-numbered field in FIG. 7 is regarded as one frame.

The sustain period is identical to that in the case shown in FIG. 7.

Although, because of the blind lines B1 to B3, higher definition than that in the first embodiment cannot be achieved, compared to the prior art structure shown in FIG. 30, production is facilitated and the pixel pitch can be further reduced, since it is not necessary to form the partitioning walls 191 to 196.

It is also feasible to perform the whole-screen write discharge and the whole-screen self-erasing discharge in the reset period as same as the reset period shown in FIG. 7.

It is to be noted that even if the PDP is of a driving type which does not discharge at the blind lines B1 to B3, by making an observer-side surface of the blind films 41 to 43 darker than the phosphor, preferably black, in order to absorbs incident light to the blind lines B1 to B3 from the outside, the contrast of an image on the PDP in bright place increases more than a case that incident light to the phosphor at the blind lines B1 to B3 from the outside is reflected and enters eyes of an observer.

Tenth Embodiment

Figure 27A:
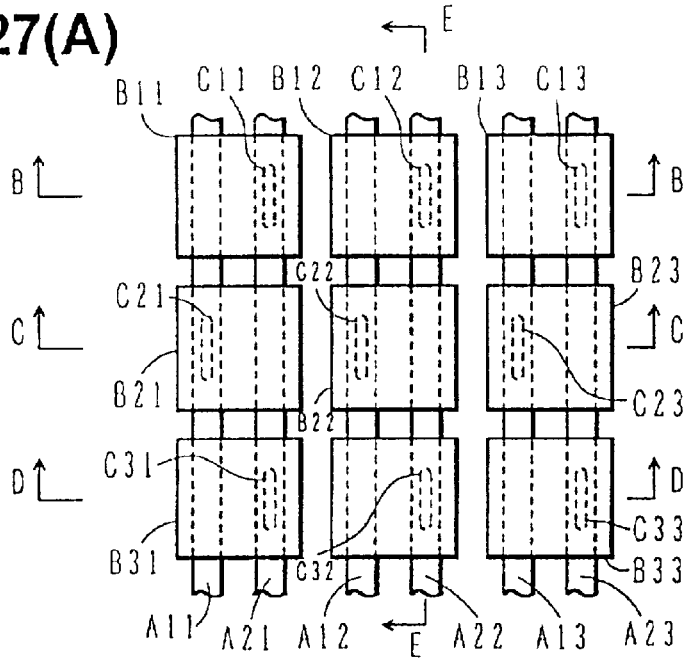
FIG. 27(A) is a plan view of address electrodes in the tenth embodiment according to the present invention and FIGS. 27(B) to 27(E) are cross sectional views along lines B—B, C—C, D—D and E—E respectively in FIG. 27(A)
Figure 27E:
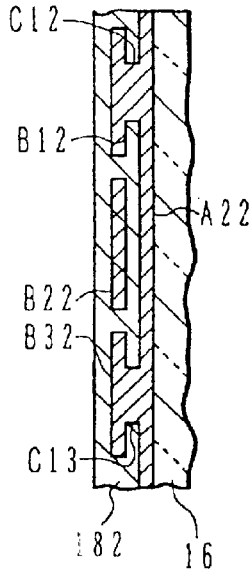
Figure 27B:
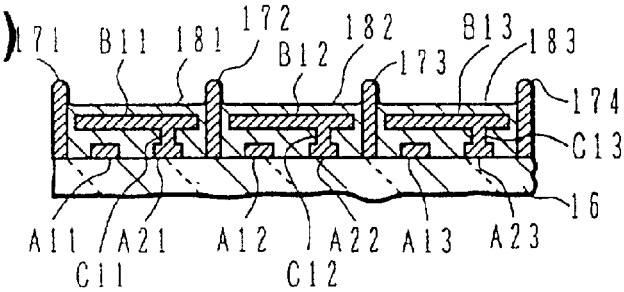
Figure 27C:
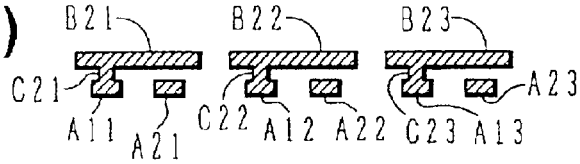
Figure 27D:
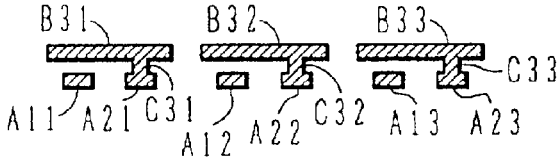
Figure 28A:
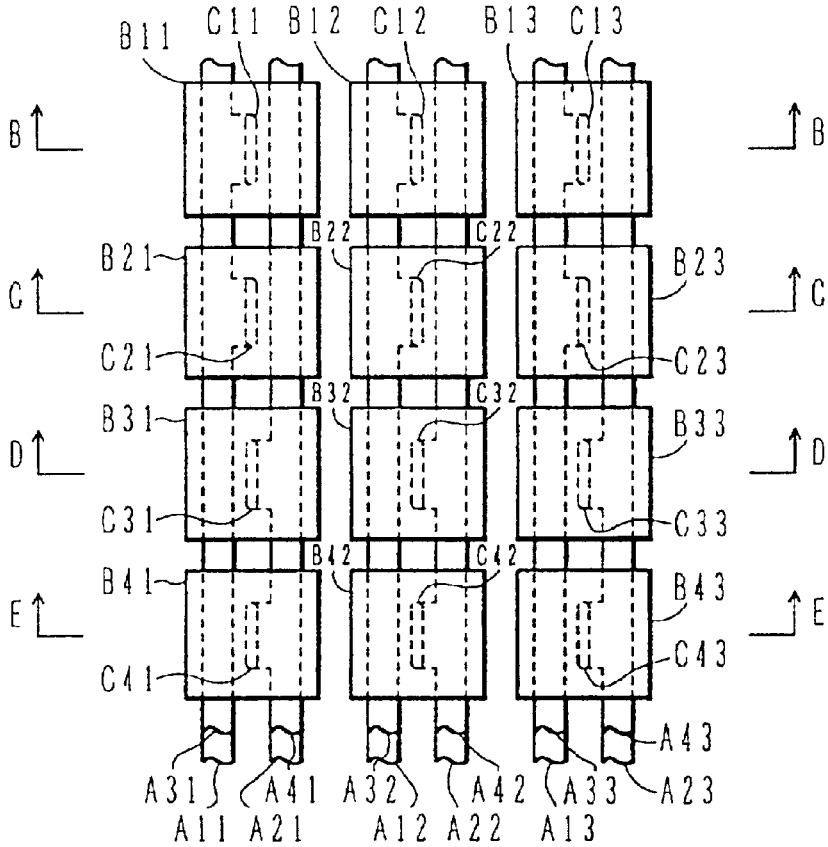
FIG. 28(A) is a plan view of address electrodes in the eleventh embodiment according to the present invention and FIGS. 28(B) to 28(E) are cross sectional views along lines B—B, C—C, D—D and E—E respectively in FIG. 28(A)
Figure 28B:
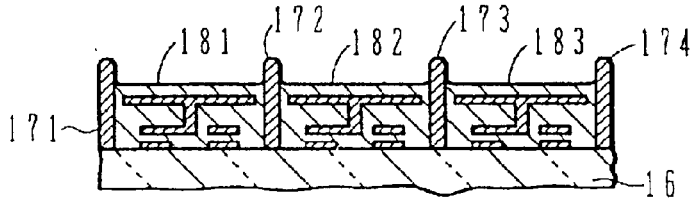
Figure 28C:
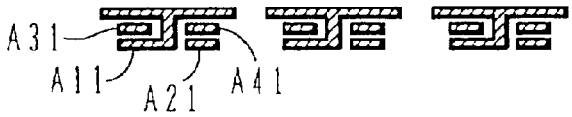
Figure 28D:
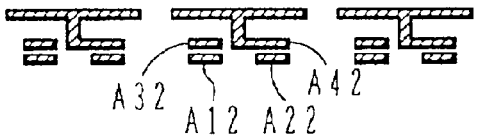
Figure 28E:
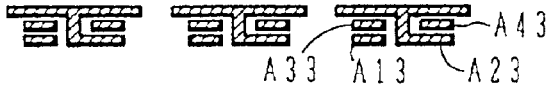

FIGS. 27(A) to 27(E) show the address electrodes in the 10th embodiment according to the present invention. FIG. 27(A) is a plan view and FIGS. 27(B) to 27(E) are cross sections along lines B—B, C—C, D—D, and E—E respectively in FIG. 27(A). In FIGS. 28(B) and 28(E), the structure surrounding the address electrodes is also shown, which facilitates understanding of the structures of other portions in relation to FIG. 2.

In correspondence to the address electrode A1 in FIG. 2, i.e. in correspondence to one monochromatic pixel row, a pair of address electrodes A11 and A21 are formed on a glass substrate 16. Above the glass substrate 16 and within the phosphor, pads B11, B21 and B31 are formed in correspondence to the individual monochromatic pixels. The address electrode A11 is connected to the pad B21 via a contact C21 and the address electrode A21 is connected to the pad B11 and B31 via contacts C11 and C31 respectively. In other words, the pads that are arrayed in one row are connected alternately to the address electrode A11 and the address electrode A21. This applies to other address electrodes Akj, pads Bij and contacts Cij, where k=1, 2, i=1 to 3 and j=1, 3.

In such a structure, a given odd-numbered line and a given even-numbered line, i.e., the line constituted with the pads B11 to B13 and the line constituted with the pads B21 to B23, for instance, can be selected at the same time, an address pulse for the line constituted of the pads B21 to B23 can be supplied to the address electrodes A11 to A13 and at the same time, an address pulse for the line constituted with the pads B11 to B13 can be supplied to the address electrodes A21 to A23.

Consequently, the address period is reduced by half compared to that in the prior art. Therefor, the sustaining discharge period is increased. With this, it is possible to increase the number of sub frames to achieve a higher number of gradations or to increase the number of times sustaining discharge is performed and achieve higher brightness.

The tenth embodiment according to the present invention may be adopted in various types of PDPs.

Eleventh Embodiment

FIG. 28 shows the address electrodes in the eleventh embodiment according to the present invention. FIG. 28(A) is a plan view and FIGS. 28(B) to 28(E) are cross sections along lines B—B, C—C, D—D, and E—E in FIG. 28(A) respectively. FIG. 28(B) also shows the structure of the surrounding area of the address electrodes.

In this embodiment, four address electrodes are formed in each area between partitioning walls and above the address electrodes, pads are formed inside the phosphors, with one column of pads connected sequentially to four electrode lines. In FIG. 28, reference characters A11 to A43 indicate address electrodes, reference characters B11 to B43 indicate pads and reference characters C11 to C43 indicate contacts.

With the address electrodes structured in this manner, any two odd-numbered lines and any two even-numbered lines can be selected at the same time for supplying an address pulse.

Twelfth Embodiment

Figure 29:
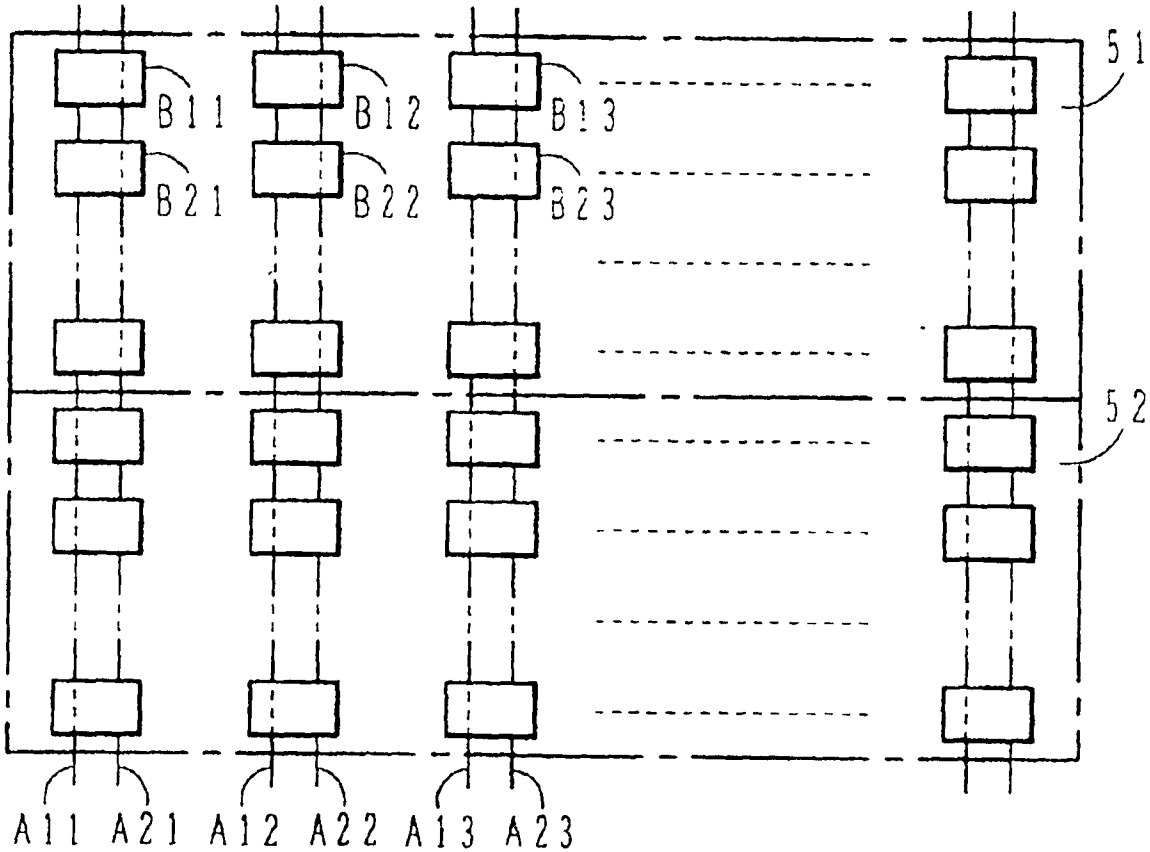
FIG. 29 shows a schematic structure of address electrodes in the twelfth embodiment according to the present invention.

FIG. 29 shows the schematic structure of the address electrodes in the twelfth embodiment according to the present invention.

In this embodiment, the display surface is divided into two portions, i.e., an area 51 and an area 52, with the address electrode A11 connected to pads in the area 51 and the address electrode A21 connected to pads in the area 52. The same applies to all the other address electrodes and pads.

In such a structure, any display line in the area 51 and any display line in the area 52 can be selected at the same time for supplying an address pulse.

Although preferred embodiments of the present invention has been described, it is to be understood that the invention is not limited thereto and that various changes and modifications may be made without departing from the spirit and scope of the invention.

For instance, although, in the embodiments described so far, the address electrodes and the X electrodes and the Y electrodes are formed at glass substrates that face each other across the discharge space, the present invention may be applied in a structure in which they are all formed on the same glass substrate.

In addition, although, in the embodiments described so far, whole-screen erasure of the wall charge is performed during the reset period, and write of the wall charge is performed for the pixels that are to be lit during an address period, the present invention may be applied in a structure in which whole-screen write is performed for the wall charge during a reset period and the wall charge is erased for the pixels to be turned off during an address period.

Moreover, in FIG. 1, the metal electrode 131 may be formed on the reverse surface or both surfaces of the transparent electrode 121 or in the transparent electrode 121. The same applies to all the other metal electrodes in FIGS. 1, 19 and 24.

What is claimed is:

1. A method of driving a plasma display panel having a plurality of pairs of display electrodes with each pair including an X-electrode and a Y-electrode, said method comprising the steps of:

applying at least one first discharge sustaining pulse to a first pair of said display electrodes; and simultaneously applying at least one second discharge sustaining pulse to a second pair of said display electrodes, said second pair of display electrodes being adjacent to said first pair of display electrodes, wherein said at least one first discharge sustaining pulse and said at least one second discharge sustaining pulse are applied such that a current in said first pair of display electrodes flows in the opposite direction from a current in said second pair of display electrodes.

2. The method according to claim 1, further comprising:

applying a set of said first discharge sustaining pulses to each electrode, respectively, in said first pair of display electrodes, both of said sets of first discharge sustaining pulses being different in phase from each other; and simultaneously applying a set of said second discharge sustaining pulses to each electrode, respectively, in said second pair of display electrodes, both of said sets of second discharge sustaining pulses being different in phase from each other;

wherein said set of first discharge sustaining pulses applied to one electrode in said first pair of display electrodes and said set of second discharge sustaining pulses applied to an adjacent electrode in said second pair of display electrodes are in the same phase as each other.

3. The method according to claim 1, wherein said X-electrodes and said Y-electrodes are arranged to be substantially parallel to each other, whereby said at least one first discharge sustaining pulse and said at least one second discharge sustaining pulse are applied such that said current in said first pair of display electrodes flows in a substantially parallel, but opposite, direction to said current in said second pair of display electrodes.

4. A method of driving a plasma display panel having a plurality of pairs of display electrodes, said method comprising the steps of:

applying a set of first discharge sustaining pulses to each electrode, respectively, in a first pair of said display electrodes, both of said sets of first discharge sustaining pulses being different in phase from each other; and simultaneously applying a set of second discharge sustaining pulses to each electrode, respectively, in an adjacent pair of said display electrodes, both of said sets of second discharge sustaining pulses being different in phase from each other;

wherein said first set of discharge sustaining pulses applied to one electrode in said first pair of display electrodes and said second set of discharge sustaining pulses applied to an adjacent electrode in said second pair of display electrodes are in the same phase as each other.

5. The method according to claim 4, wherein each of the pairs of display electrodes includes an X-electrode and a Y-electrode, and wherein said X-electrodes and said Y-electrodes are arranged to be substantially parallel to each other, whereby said set of first discharge sustaining pulses and said second set of discharge sustaining pulses are applied such that said current in each of said first pairs of display electrodes flows in a substantially parallel, but opposite, direction to said current in each of said second pairs of display electrodes.

* * * * *